US010766731B2

(12) United States Patent
Yokoo et al.

(10) Patent No.: US 10,766,731 B2
(45) Date of Patent: Sep. 8, 2020

(54) SHEET STORAGE APPARATUS AND SHEET STORAGE METHOD

(71) Applicant: GLORY LTD., Hyogo (JP)

(72) Inventors: Tomohiro Yokoo, Himeji (JP); Youichi Takemura, Himeji (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/331,780

(22) PCT Filed: Aug. 8, 2017

(86) PCT No.: PCT/JP2017/028832
§ 371 (c)(1),
(2) Date: Mar. 8, 2019

(87) PCT Pub. No.: WO2018/047567
PCT Pub. Date: Mar. 15, 2018

(65) Prior Publication Data

US 2019/0279453 A1 Sep. 12, 2019

(30) Foreign Application Priority Data

Sep. 9, 2016 (JP) ..... 2016-176213

(51) Int. Cl.
*B65H 43/06* (2006.01)
*B65H 31/10* (2006.01)
(Continued)

(52) U.S. Cl.
CPC ..... *B65H 43/06* (2013.01); *B65H 31/10* (2013.01); *G07D 11/0096* (2013.01); *B65H 31/3045* (2013.01); *B65H 2701/1912* (2013.01)

(58) Field of Classification Search
CPC ..... B65H 31/3045; B65H 43/06; B65H 29/34
See application file for complete search history.

(56) References Cited

U.S. PATENT DOCUMENTS 5,676,366 A * 10/1997 Polidoro ..... B65H 29/46 271/176
2015/0266689 A1 9/2015 Hashimoto
(Continued)

FOREIGN PATENT DOCUMENTS

EP 0919500 A2 6/1999
JP 63-117874 5/1988
(Continued)

OTHER PUBLICATIONS

International Search Report issued in International Bureau of WIPO Patent Application No. PCT/JP2017/028832, dated Oct. 10, 2017, along with an English translation thereof.
(Continued)

*Primary Examiner* — Howard J Sanders
(74) *Attorney, Agent, or Firm* — Greenblum & Bernstein, P.L.C.

(57) ABSTRACT

A sheet storage apparatus (for example, a banknote storage mechanism) includes an entering unit (for example, a pushing unit) configured to enter into a storage bag (for example, a banknote storage bag) supported by a supporter (for example, holding members) and a controller configured to control the driving unit (for example, a motor) for driving the entering unit. The controller controls the driving unit such that the entering unit enters into the storage bag supported by the supporter and comes in contact with the sheet stored in the storage bag to detect an upper end position of the sheet stored in the storage bag.

10 Claims, 13 Drawing Sheets

(51) Int. Cl.
*G07D 11/00* (2019.01)
*B65H 31/30* (2006.01)

(56) References Cited

U.S. PATENT DOCUMENTS

| | | | | |
|---|---|---|---|---|
| 2016/0031574 | A1* | 2/2016 | Razzaboni | B65B 7/02 53/268 |
| 2019/0092598 | A1* | 3/2019 | Nishimura | G07D 11/23 |
| 2020/0027300 | A1* | 1/2020 | Baydin | B65B 57/20 |

FOREIGN PATENT DOCUMENTS

| | | |
|---|---|---|
| JP | 2012-174130 | 9/2012 |
| WO | 2016/136517 | 9/2016 |

OTHER PUBLICATIONS

Written Opinion of the International Searching Authority issued in International Bureau of WIPO Patent Application No. PCT/JP2017/028832, dated Oct. 10, 2017, along with an English translation thereof.
Japanese Office Action dated Apr. 1, 2020 issued in Japanese Patent Application No. 2016-176213 and an English translation.
Extended European Search Report dated Apr. 17, 2020 issued in European Application No. 17848511.6.

* cited by examiner

SHEET STORAGE APPARATUS AND SHEET STORAGE METHOD

TECHNICAL FIELD

The present invention relates to a sheet storage apparatus and a sheet storage method for storing sheets such as banknotes in a storage bag such as a pouch bag having an opening for inserting the sheets.

BACKGROUND ART

As a sheet handling machine for depositing sheets such as banknotes, one in which sheets taken into a housing are stored in a storage bag such as a pouch bag has been conventionally used. As such a sheet handling machine, for example, one disclosed in Japanese Patent Publication No. 2012-174130 (JP2012-174130A) and the like is conventionally known. Further, in the sheet handling machine in which the storage bag such as the pouch bag is used, it is conceivable to push the sheets remaining on a temporary storage unit into an inside of the storage bag by a pushing plate, when the sheets are stored in the storage bag held by each holding member.

Further, in the sheet handling machine in which the storage bag such as the pouch bag is used, when the sheets are stored in the storage bag held by each holding member, a method of imaging a mark provided on an inner wall portion of the storage bag by an imaging unit is conceivable. In such a sheet handling machine, it is judged that the storage bag has become a full state or nearly full state, when a predetermined amount of sheets are stored in the storage bag and then the mark is obstructed by the sheets stored in the storage bag so that this mark is no longer shown in the image taken by the imaging unit. In this way, it is possible to detect an upper end position of the sheets stored in the storage bag based on the image taken by the imaging unit.

Also, in another conventional sheet handling machine, it is conceivable that the number of sheets sent to the storage bag held by each holding member is counted, and it is judged whether the storage bag becomes a full state or nearly full state based on the counted number of sheets.

SUMMARY OF THE INVENTION

However, in the conventional sheet handling machine, when the upper end position of the sheets stored in the storage bag is detected based on the image captured by the imaging unit, it is necessary to install the imaging unit, resulting in an increase in cost. Also, in the case of counting the number of sheets sent to the storage bag held by each holding member and judging whether the storage bag becomes the full state or nearly full state based on the counted result, the upper end position of the sheets stored in the storage bag could not be accurately detected. Specifically, since kinds or states of the sheets stored in the storage bag are not constant, it is difficult to obtain information on the substantial thickness of the stored sheets, and there is a possibility that the upper end position of the sheets could not be accurately detected. Therefore, in the conventional sheet handling machine, when the opening of the storage bag is sealed by heat by a pair of heating members, the sheet located at the top of the sheets stored in the storage bag is sandwiched between the pair of heating members and an unsealed portion is generated in the opening of the storage bag in some cases.

The present invention has been made in view of such circumstances, and an object of the present invention is to provide a sheet storage apparatus and a sheet storage method that can reliably detect an upper end position of sheets stored inside the storage bag, and therefore it is possible to prevent occurrence of an unsealed portion at the opening of the storage bag when the opening of the storage bag is sealed by heat by a pair of heating members.

A sheet storage apparatus of the present invention for storing a sheet in a storage bag having an opening for inserting the sheet includes: a supporter configured to support a portion of the storage bag in the vicinity of the opening of the storage bag; an entering unit configured to enter into the storage bag supported by the supporter; a driving unit configured to drive the entering unit; and a controller configured to control the driving unit such that the entering unit enters into the storage bag supported by the supporter and comes in contact with the sheet stored in the storage bag to detect an upper end position of the sheet stored in the storage bag.

In the sheet storage apparatus of the present invention, the controller may perform control such that the upper end position of the sheet stored in the storage bag supported by the supporter is maintained at a predetermined height.

In the sheet storage apparatus of the present invention, the entering unit may move between a standby position which is a position above the storage bag supported by the supporter and a lower end position where the entering unit enters into the storage bag supported by the supporter, and the sheet storage apparatus may further include a first detector configured to detect whether or not the entering unit is located at the lower end position.

In this case, the sheet storage apparatus of the present invention may further include a platform configured to move in a substantially vertical direction and on which at least a part of the storage bag supported by the supporter is placed, and when the entering unit enters into the storage bag and comes in contact with the sheet stored in the storage bag, the controller may control the platform to lower the platform when it is not detected by the first detector that the entering unit is located at the lower end position.

The sheet storage apparatus of the present invention may further include a storage bag position adjuster configured to move the position of a bottom portion of the storage bag supported by the supporter in a substantially vertical direction, and when the entering unit enters into the storage bag and comes in contact with the sheet stored in the storage bag, the controller may control the storage bag position adjuster to lower the bottom portion of the storage bag when it is not detected by the first detecting unit that the entering unit is located at the lower end position.

Also, the sheet storage apparatus of the present invention may further include a stopping mechanism configured to stop the entering unit from moving toward the lower end position, when the entering unit comes in contact with the sheet stored in the storage bag before the entering unit reaches the lower end position.

In the sheet storage apparatus of the present invention, the entering unit may enter into the storage bag supported by the supporter and pushes the sheet stored in the storage bag downward.

In the sheet storage apparatus of the present invention, the controller may also detect a height of the sheet stored in the storage bag supported by the supporter.

The sheet storage apparatus of the present invention may further include a platform configured to move in a substantially vertical direction and on which at least a part of the storage bag supported by the supporter is placed; and a second detector configured to detect a position of the platform, and the controller may detect the height of the sheet stored in the storage bag based on the upper end position of the sheet stored in the storage bag detected by the controller and the position of the platform detected by the second detector.

A sheet storage method of the present invention for storing a sheet in a storage bag having an opening for inserting the sheet includes: supporting a portion of the storage bag in the vicinity of the opening of the storage bag by a supporter; storing the sheet in the storage bag supported by the supporter; and detecting an upper end position of the sheet stored in the storage bag by causing an entering unit to enter into the storage bag supported by the supporter and to come in contact with the sheet stored in the storage bag.

BRIEF DESCRIPTION OF THE DRAWINGS

FIG. 4 is a side view showing a configuration of a banknote storage bag to be held by each holding member of the banknote storage mechanism shown in FIG. 2 and the like.

FIG. 11 is a functional block diagram showing a configuration of a control system in the banknote handling machine shown in FIG. 1 and the like.

DESCRIPTION OF THE PREFERRED EMBODIMENTS

Figure 1:
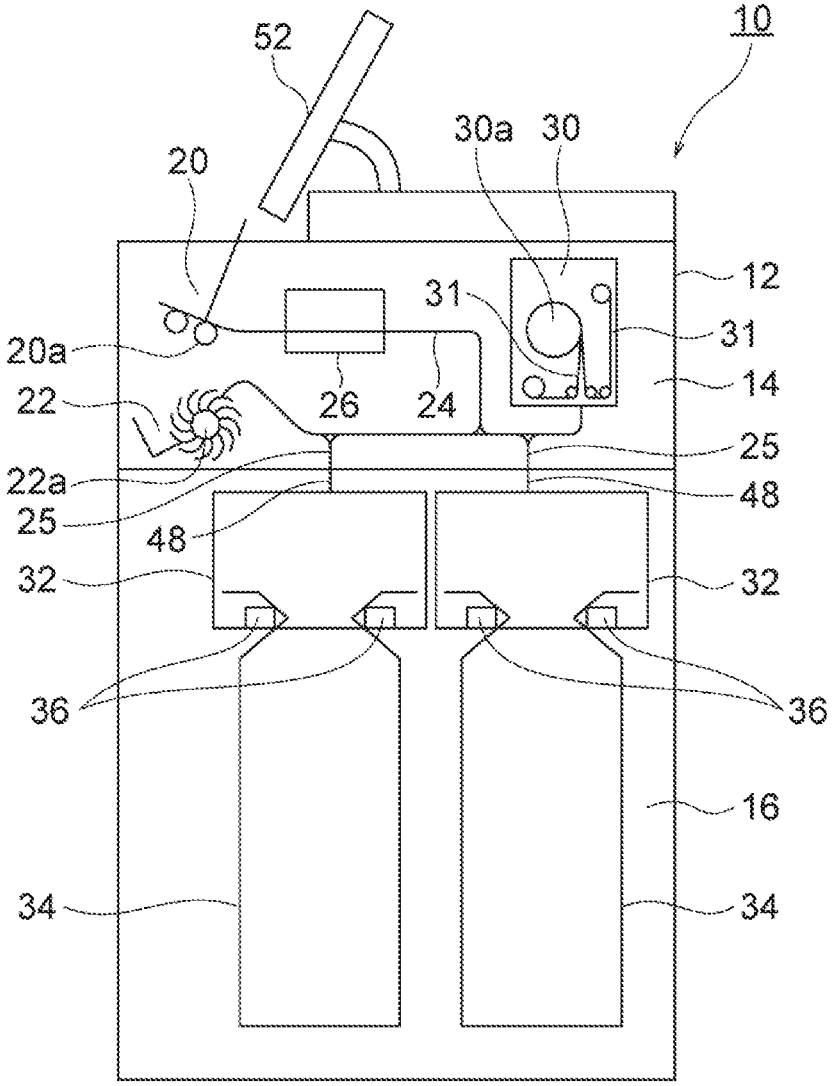
FIG. 1 is a schematic configuration diagram schematically showing an internal configuration of a banknote handling machine according to an embodiment of the present invention.
Figure 2:
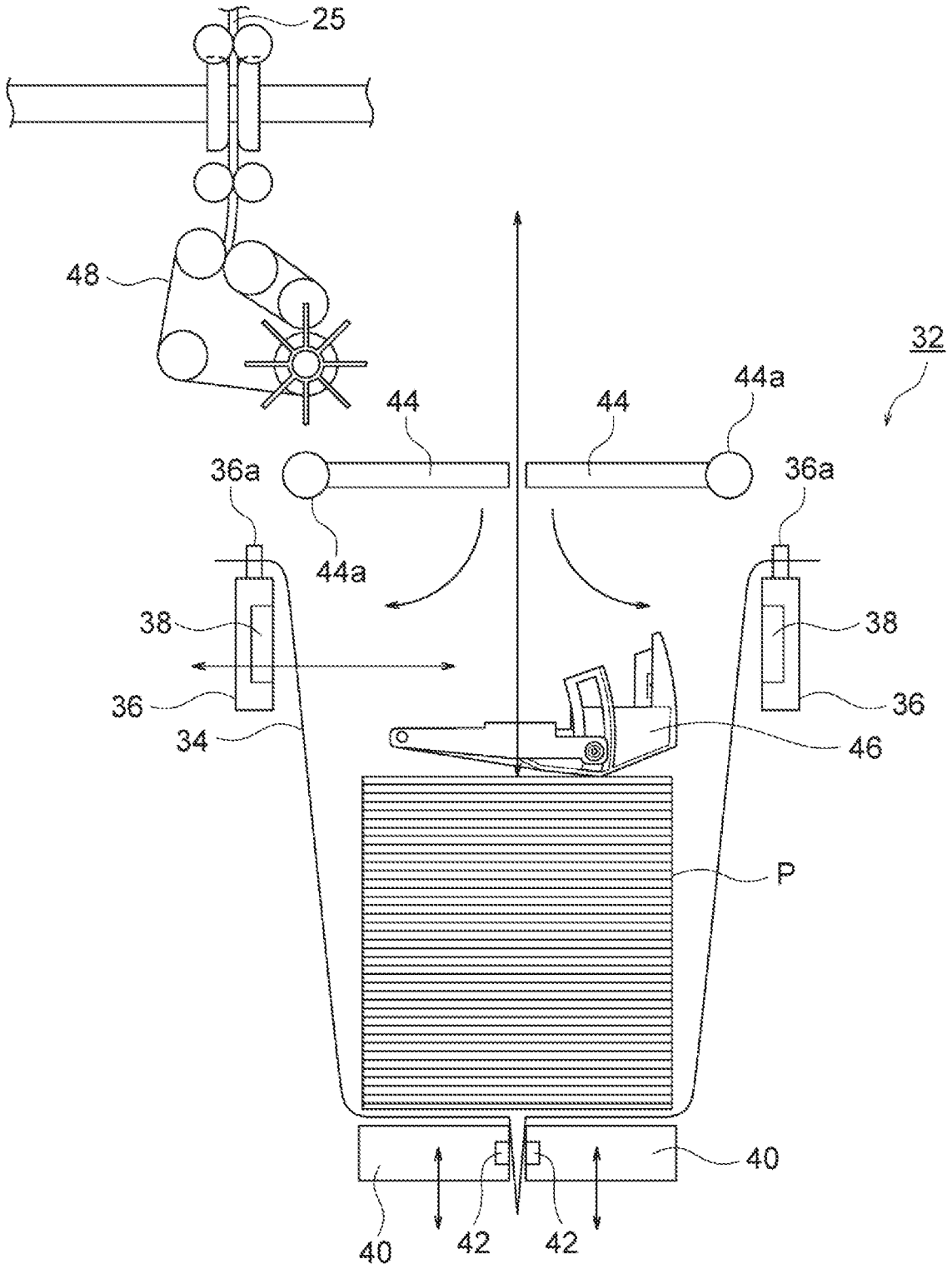
FIG. 2 is a side view showing a detail of a configuration of a banknote storage mechanism in the banknote handling machine shown in FIG. 1.
Figure 3:
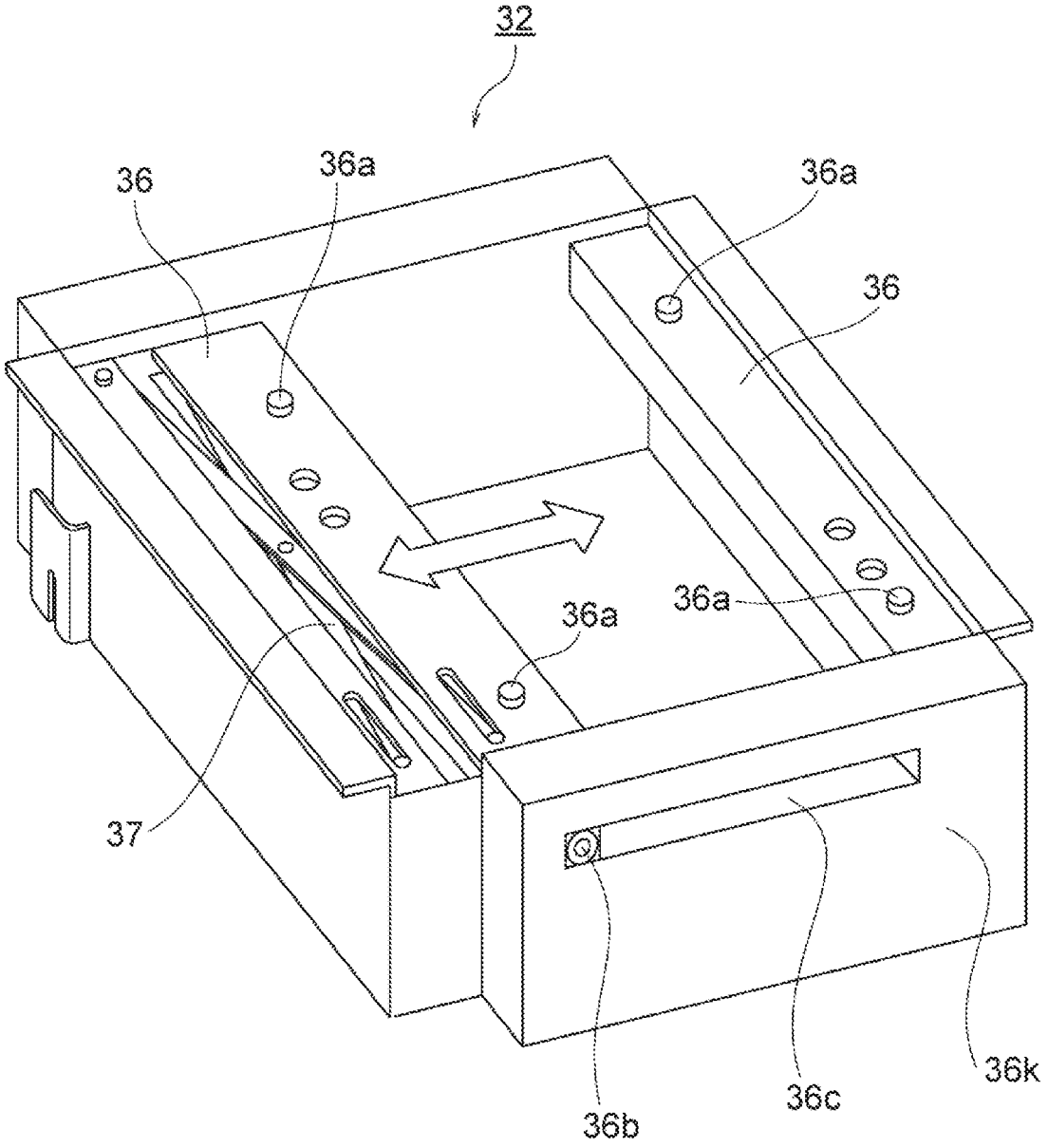
FIG. 3 is a perspective view showing a configuration of a pair of holding members and the like in the banknote storage mechanism shown in FIG. 2.
Figure 4:
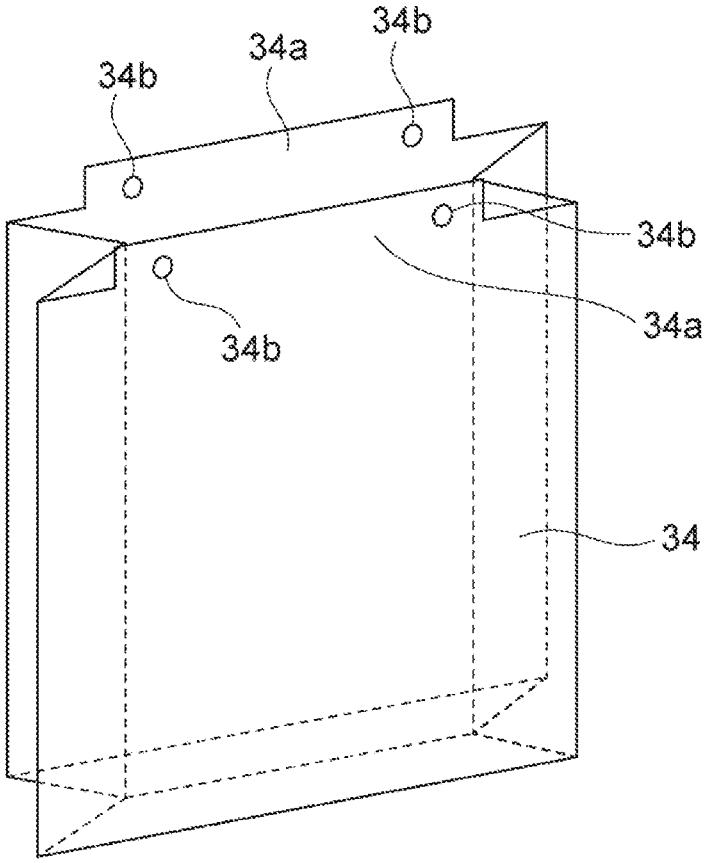
Figure 5:
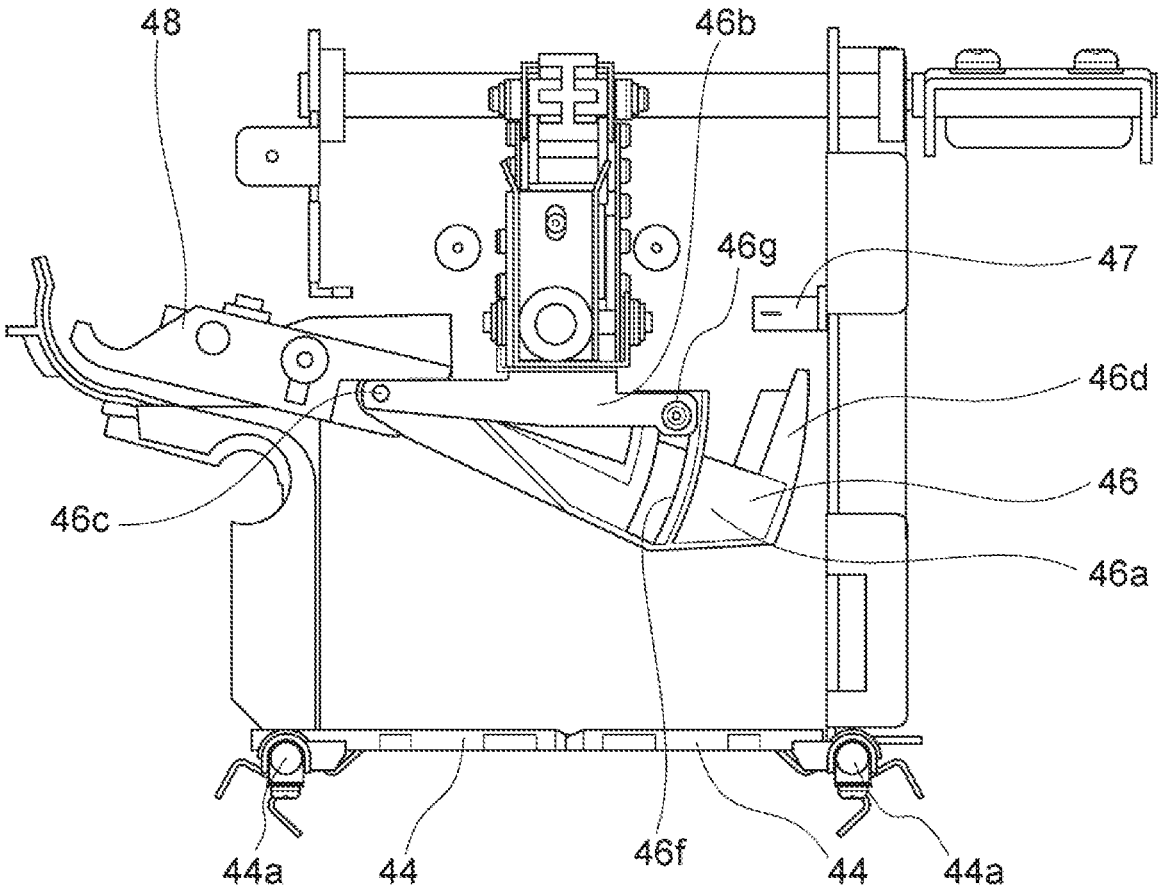
FIG. 5 is a side view showing a configuration of a pushing unit, a temporary storage unit and the like in the banknote storage mechanism shown in FIG. 2, and shows a state when banknotes are not held in the temporary storage unit.
Figure 6:
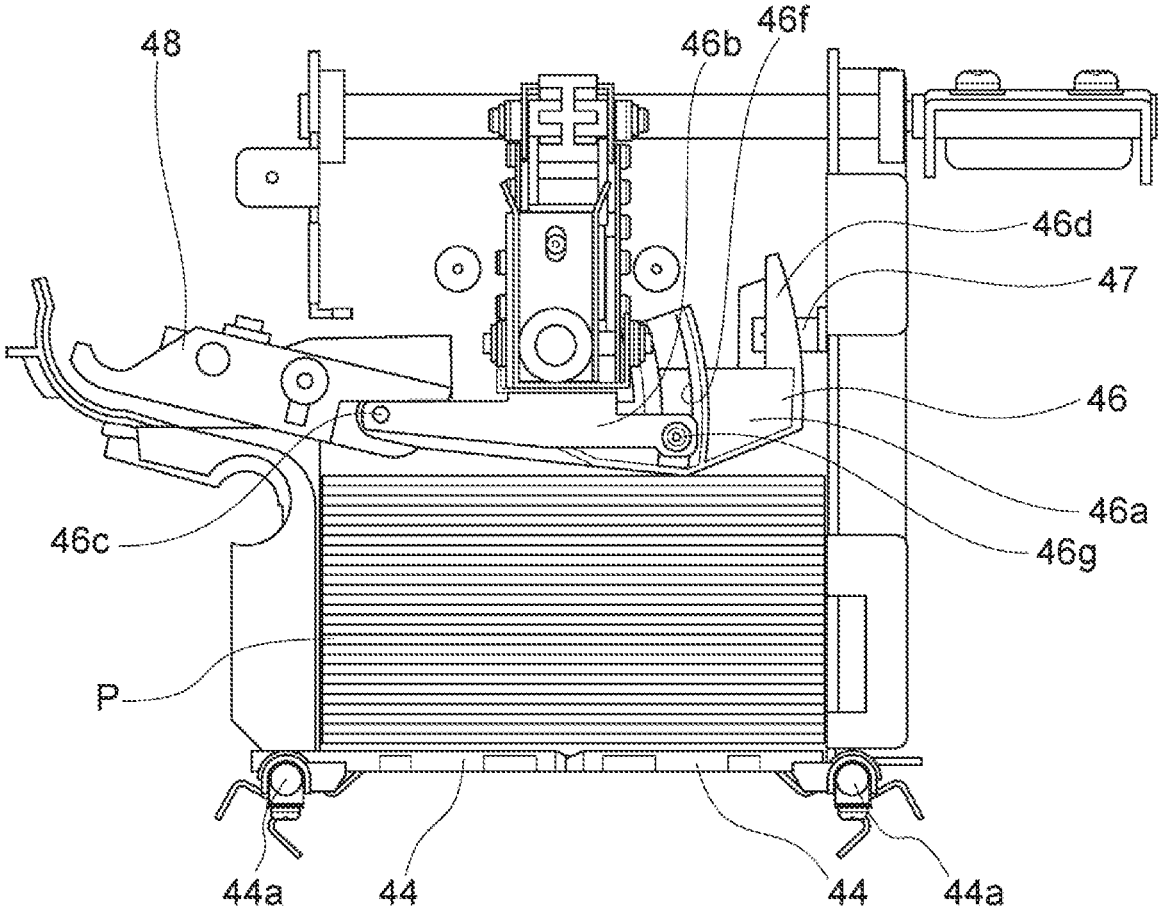
FIG. 6 is a side view showing a configuration of the pushing unit, the temporary storage unit and the like in the banknote storage mechanism shown in FIG. 2, and shows a state when banknotes are held in the temporary storage unit in a full state or nearly full state.
Figure 7:
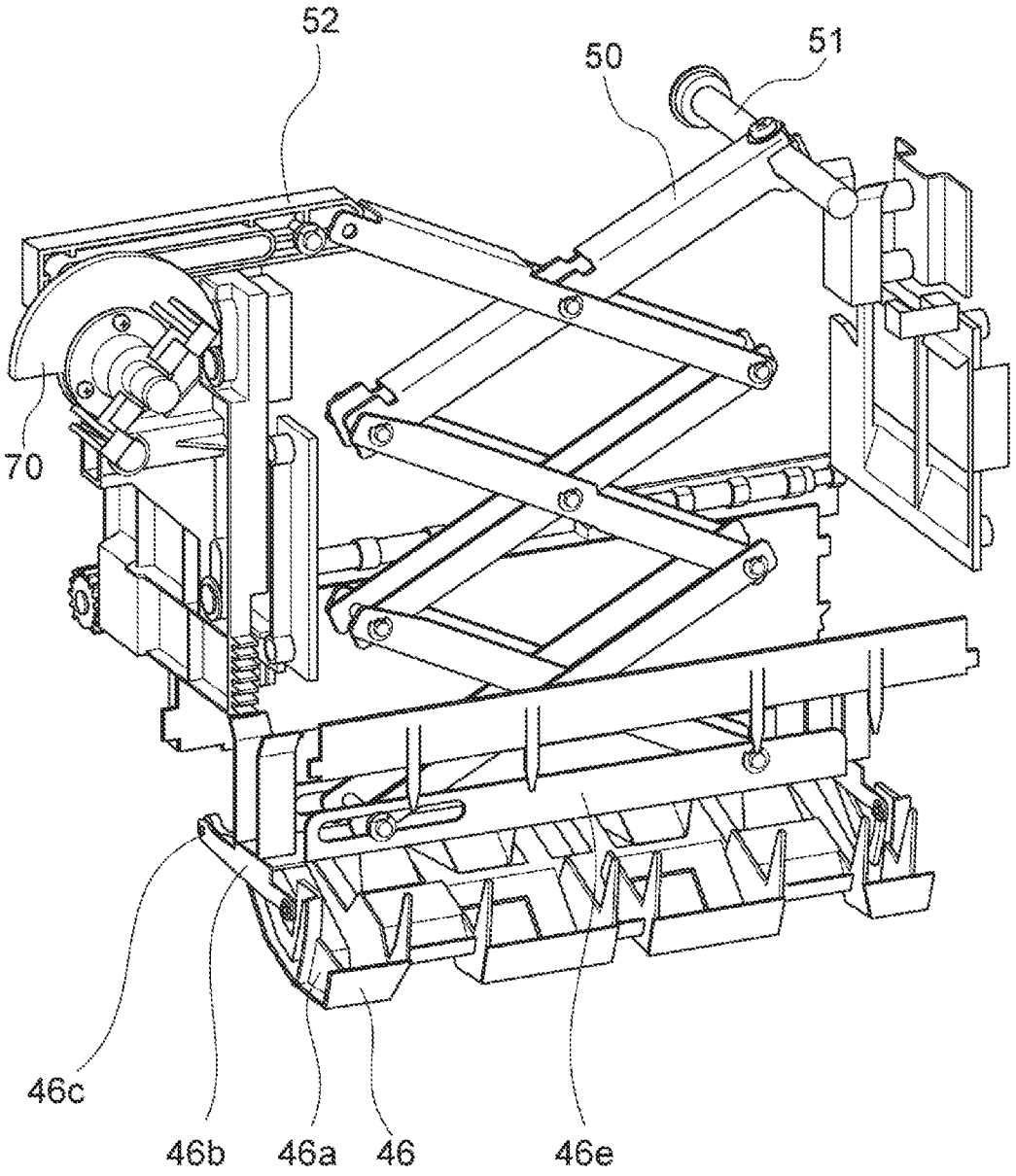
FIG. 7 is a perspective view showing a configuration of a pantograph or the like for moving the pushing unit in the banknote storage mechanism shown in FIG. 2.
Figure 8:
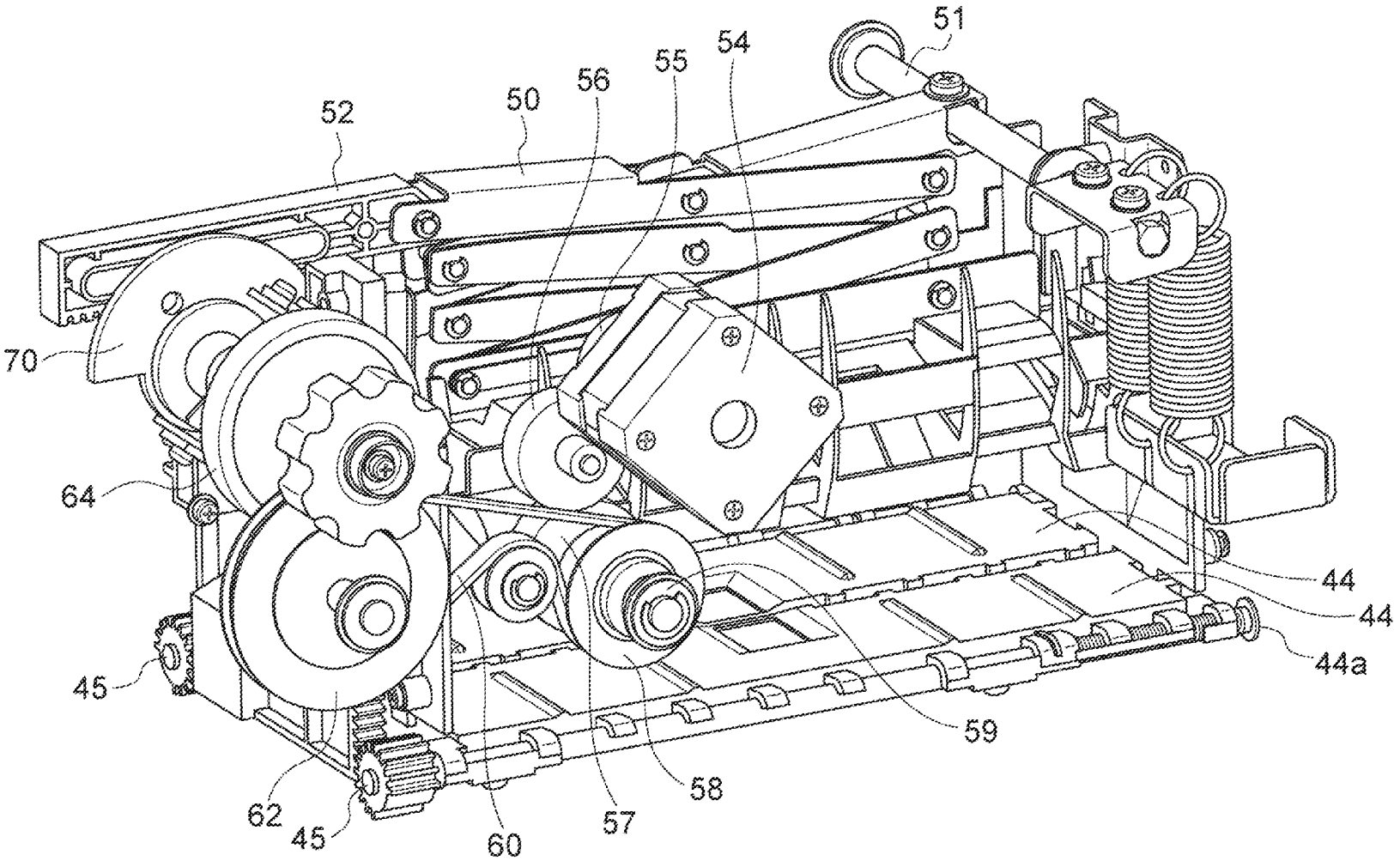
FIG. 8 is a perspective view showing a configuration of a motor, a gear, a pinion rack, and the like for operating the pantograph in the banknote storage mechanism shown in FIG. 2.
Figure 9:
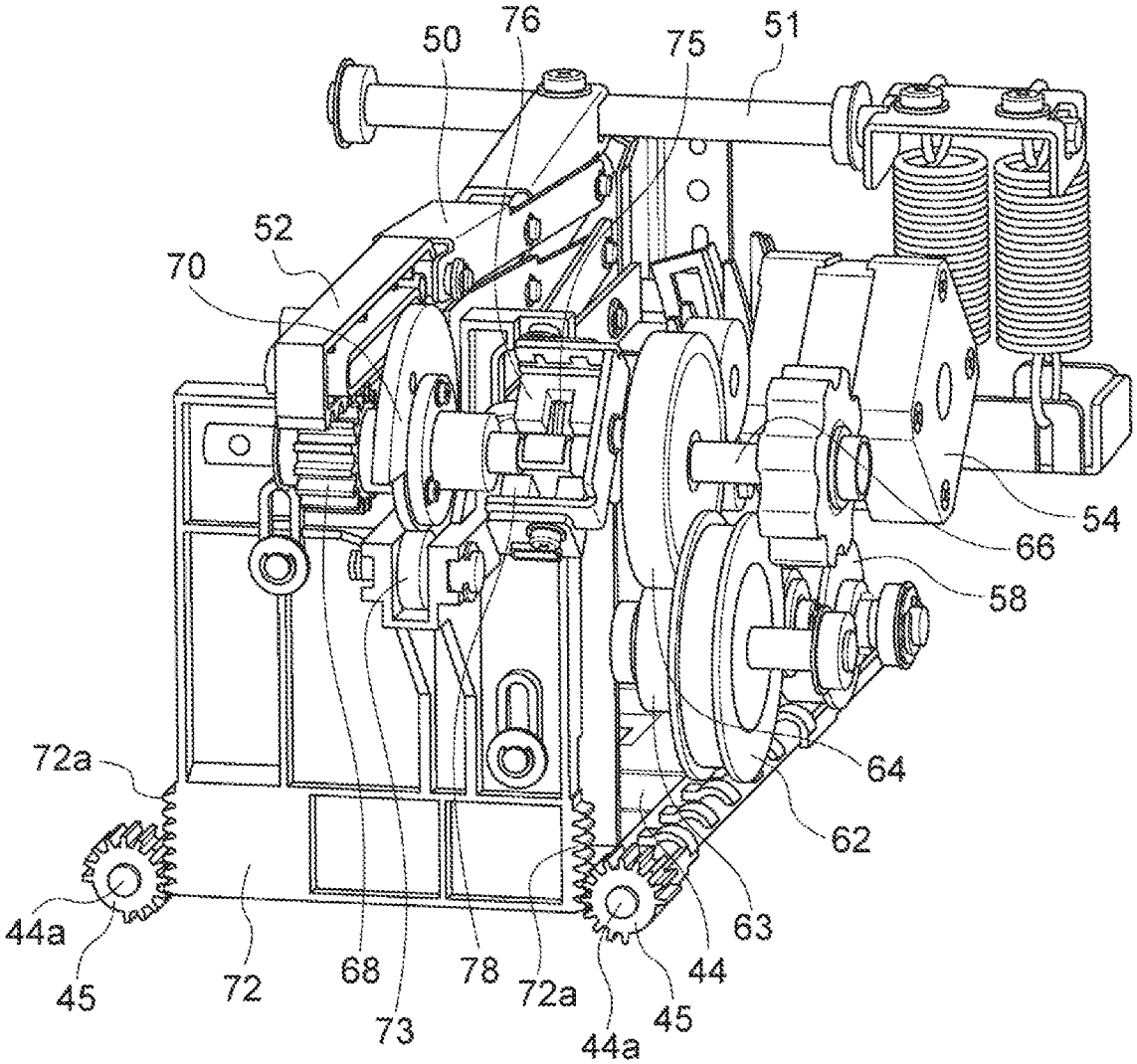
FIG. 9 is a perspective view showing the motor, the gear, the pinion rack, and the like for operating the pantograph in the banknote storage mechanism shown in FIG. 2, as viewed from another direction.
Figure 10:
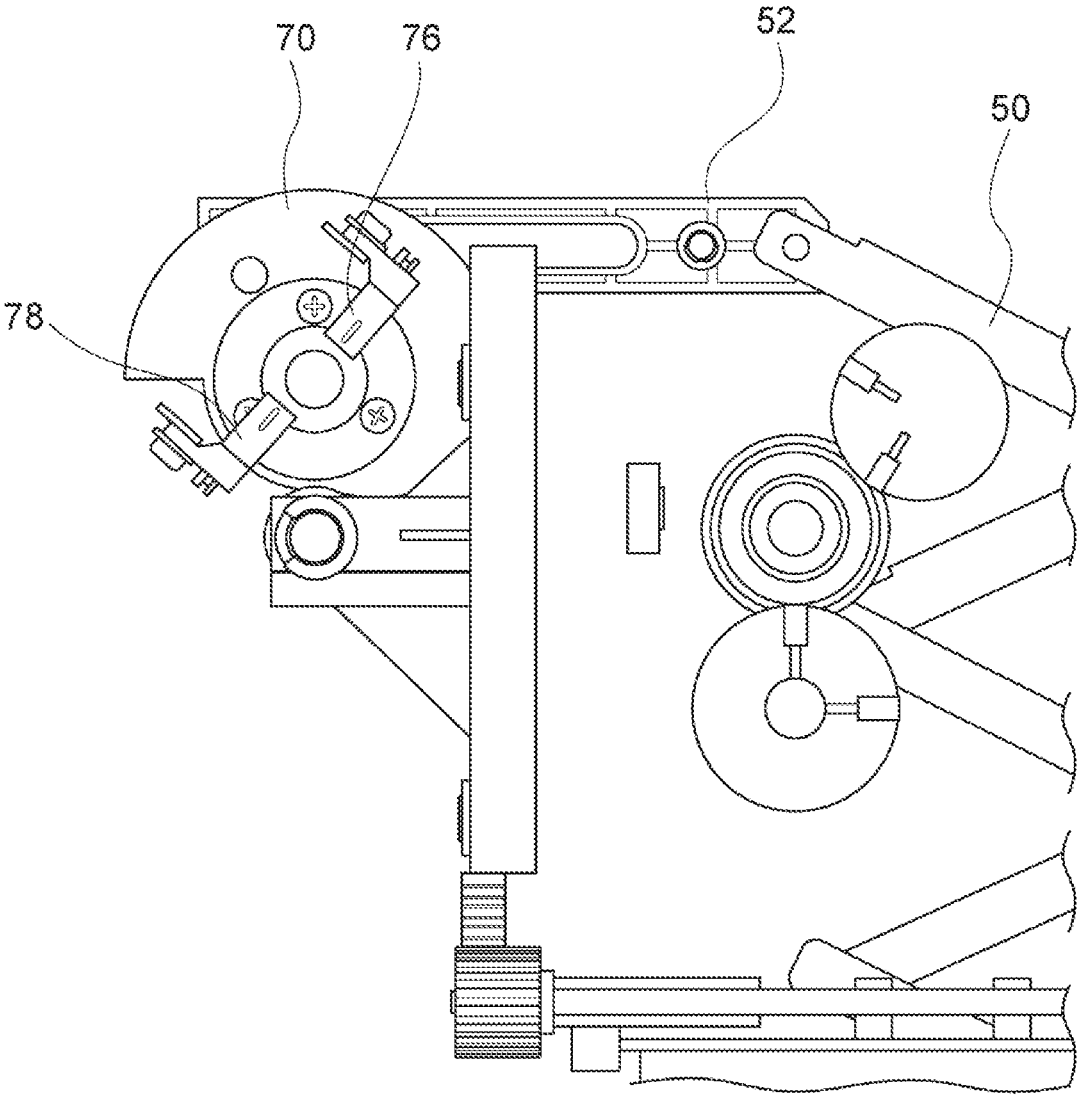
FIG. 10 is a side view showing a configuration of an upper end detection sensor and a lower end detection sensor for detecting a position of the pantograph in the banknote storage mechanism shown in FIG. 2.
Figure 11:
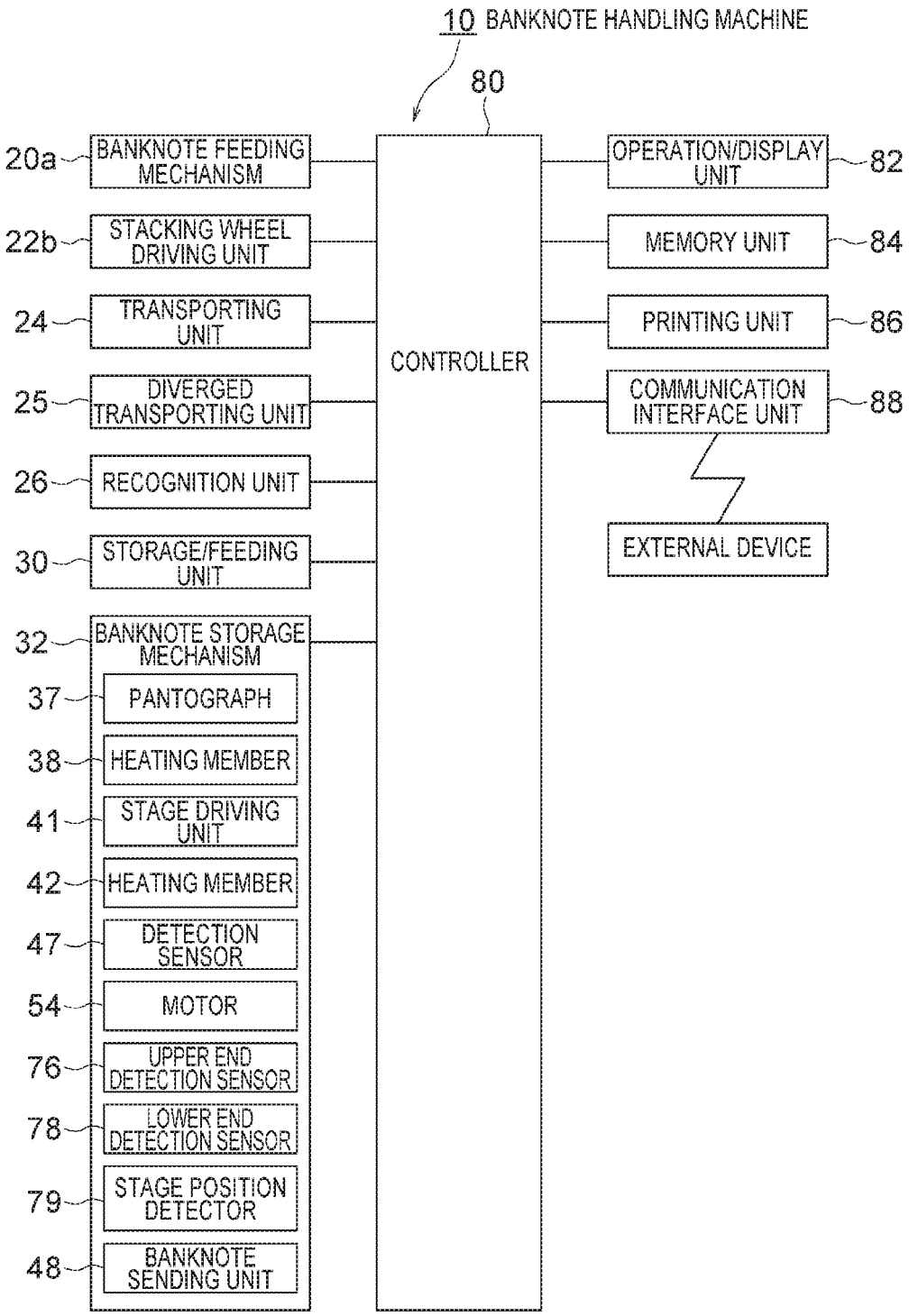

Hereinafter, an embodiment of the present invention will be described with reference to the drawings. FIGS. 1 to 11 are diagrams showing a banknote handling machine according to the present embodiment. Among these diagrams, FIG. 1 is a schematic configuration diagram schematically showing an internal configuration of the banknote handling machine according to the present embodiment, FIG. 2 is a side view showing a detail of a configuration of a banknote storage mechanism in the banknote handling machine shown in FIG. 1, and FIG. 3 is a perspective view showing a configuration of a pair of holding members and the like in the banknote storage mechanism shown in FIG. 2. FIG. 4 is a side view showing a configuration of a banknote storage bag to be held by each holding member of the banknote storage mechanism shown in FIG. 2 and the like. Each of FIGS. 5 and 6 is a side view showing a configuration of a pushing unit, a temporary storage unit in the banknote storage mechanism shown in FIG. 2. FIG. 7 is a perspective view showing a configuration of a pantograph for moving the pushing unit in the banknote storage mechanism shown in FIG. 2. Each of FIGS. 8 and 9 is a perspective view showing a configuration of a motor, a gear, a pinion rack, and the like for operating the pantograph in the banknote storage mechanism shown in FIG. 2. FIG. 10 is a side view showing a configuration of an upper end detection sensor and a lower end detection sensor for detecting a position of the pantograph in the banknote storage mechanism shown in FIG. 2. FIG. 11 is a functional block diagram showing a configuration of a control system in the banknote handling machine shown in FIG. 1 and the like. In FIG. 2, FIG. 6, and the like, a plurality of banknotes in a stacked state is indicated by a reference symbol P.

A banknote handling machine 10 according to the present embodiment is generally installed in a front office area or back office area of a store such as a supermarket, or placed in a lobby of a bank or an inside of the bank, and the banknote handling machine 10 can perform various processes such as deposit processing of banknotes. As shown in FIG. 1, the banknote handling machine 10 according to the present embodiment has a substantially rectangular parallelepiped housing 12. A left side surface of the housing 12 in FIG. 1 is a front surface of the housing 12 (that is, the surface facing an operator). An upper assembly 14 and a lower assembly 16 are stored in the housing 12 such that the upper assembly 14 and the lower assembly 16 can be respectively drawn forward from the front surface of the housing 12 (specifically, to the left in FIG. 1). In the upper assembly 14, an inlet unit 20 such as a hopper for taking in the banknotes from outside into inside of the housing 12 is disposed at an upper part of the front surface of the housing 12 (the upper part of the left side surface in FIG. 1). Further, in the upper assembly 14, an outlet unit 22 for feeding out the banknotes from inside of the housing 12 to outside is disposed below the inlet unit 20 in the front surface of the housing 12 (the surface on the left side in FIG. 1).

The inlet unit 20 is provided with a banknote feeding mechanism 20*a* for feeding the banknotes, placed on the inlet unit 20 in a stacked state by the operator, one by one into the housing 12. In the upper assembly 14, a transporting unit 24 for transporting the banknotes one by one in the housing 12 is disposed in the housing 12 of the banknote handling machine 10. The banknotes fed out from the inlet unit 20 by the banknote feeding mechanism 20*a* are transported one by one by the transporting unit 24. The transporting unit 24 is provided with a recognition unit 26. Each banknote fed out to the transporting unit 24 by the banknote feeding mechanism 20*a* is recognized by the recognition unit 26 for denomination, authenticity, face/back, fitness, new/old, transportation state, and the like.

As shown in FIG. 1, the outlet unit 22 is connected to the transporting unit 24, and the banknote sent from the transporting unit 24 to the outlet unit 22 is stacked in the outlet unit 22. The outlet unit 22 is accessible from outside of the housing 12 so that the operator can take out the banknotes stacked in the outlet unit 22 from the front surface of the housing 12. A stacking wheel 22*a* is disposed at a connection point between the transporting unit 24 and the outlet unit 22, and the stacking wheel 22*a* is adapted to rotate in a counterclockwise direction in FIG. 1. When the banknote is sent from the transporting unit 24 to the outlet unit 22, the stacking wheel 22*a* rotates in the counterclockwise direction in FIG. 1 in a state in which the banknote is held between two blades of the stacking wheel 22*a*. Then, the banknote held between the two blades of the stacking wheel 22*a* is stacked in the outlet unit 22 in an aligned state.

In the upper assembly 14, the transporting unit 24 is provided with a tape-type storage/feeding unit 30. The banknote sent from the transporting unit 24 to the storage/feeding unit 30 is stored in the storage/feeding unit 30 and the banknotes stored in the storage/feeding unit 30 can be fed out one by one to the transporting unit 24. More specifically, the storage/feeding unit 30 is provided with a drum 30*a* rotatable in both forward and reverse directions, and one end of a pair of band-shaped tapes 31 is connected to an outer peripheral surface of the drum 30*a*. When the banknote is sent from the transporting unit 24 to the storage/feeding unit 30, the banknote is wound on the drum 30*a* by each band-shaped tape 31 such that the banknote and each tape 31 are integrally wound on the drum 30*a*. On the other hand, when each tape 31 is rewound from the drum 30*a* by rotating the drum 30*a* in the reverse direction, the banknote wound on the drum 30*a* is discharged from each tape 31 and is fed out to the transporting unit 24.

As shown in FIG. 1, in the present embodiment, a plurality of (for example, two) banknote storage mechanisms 32 is disposed in the lower assembly 16 to store banknotes in a banknote storage bag 34 having an opening on one side for inserting banknotes. Each banknote storage mechanism 32 includes a pair of holding members 36 which space apart from each other and face each other. Two portions of the banknote storage bag 34, facing each other in the vicinity of the opening of the banknote storage bag 34, are held by the pair of holding members 36, respectively. One holding member 36 (for example, the holding member 36 on the right side in FIGS. 1 and 2) is fixedly positioned. On the other hand, the other holding member 36 (for example, the holding member 36 on the left side in FIGS. 1 and 2) can move toward the fixedly positioned holding member 36. As shown in FIG. 2, each holding member 36 is provided with a heating member 38. After a predetermined amount of the banknotes are stored in the banknote storage bag 34 held by the holding members 36 in the banknote storage mechanism 32, before the banknote storage bag 34 is taken out from the banknote storage mechanism 32, the one holding member 36 moves toward the other holding member 36. Then, after the two holding members 36 comes in contact with each other via the banknote storage bag 34, the heating members 38 heat the portion near the opening of the banknote storage bag 34. As a result, the opening of the banknote storage bag 34 is sealed by heat. In the banknote storage mechanism 32, instead of moving the one holding members 36 of the pair of holding members 36 toward the other holding member 36, both holding members 36 may be moved to a center position toward each other so that the two holding members 36 comes in contact with each other in the center position.

A plurality (two in the example shown in FIG. 1) of diverged transporting units 25, corresponding to the banknote storage mechanisms 32, diverge from the transporting unit 24 in the upper assembly 14. The banknotes diverted from the transporting unit 24 to the diverged transporting units 25 are sent from the diverged transporting units 25 to the banknote storage bags 34 mounted to the banknote storage mechanisms 32 respectively, and stored in the banknote storage bags 34.

Next, the configuration of the banknote storage mechanism 32 in the present embodiment will be described in detail with reference to FIGS. 2 to 4. FIG. 2 is a side view showing details of a configuration of the banknote storage mechanism 32, FIG. 3 is a perspective view showing a configuration of the pair of holding members 36 and the like in the banknote storage mechanism 32 shown in FIG. 2, and FIG. 4 is a side view showing a configuration of the banknote storage bag 34 to be held by each holding member 36 of the banknote storage mechanism 32 shown in FIG. 2 and the like.

As shown in FIG. 2, the banknote storage mechanism 32 includes a banknote sending unit 48, temporary storage units 44, and stages 40. The banknotes are transported from the diverged transporting unit 25 of the upper assembly 14 to the banknote sending unit 48 located in the lower assembly 16, and then, sent to the banknote storage bag 34 held by the pair of holding members 36. The banknotes sent from the banknote sending unit 48 are temporarily held by the temporary storage units 44. The bottom of the banknote storage bag 34 held by the pair of holding members 36 is placed on the stages 40.

As shown in FIG. 2, the banknote sending unit 48 is a combination of rollers and belts. The banknotes are transported from the diverged transporting unit 25 of the upper assembly 14 to the banknote sending unit 48 of the lower assembly 16. Then, the banknotes transported to the banknote sending unit 48 are sent onto the temporary storage units 44 one by one, and then stacked on the temporary storage units 44. The temporary storage units 44 consist of a pair of left and right. Each temporary storage unit 44 can rotate downward (that is, in the direction of the arrow in FIG. 2) around a shaft 44*a* provided at a proximal end portion of each temporary storage unit 44. The stages 40 consist of a pair of left and right. Each stage 40 is movable in the vertical direction and the lateral direction in FIG. 2. A gap is formed between the pair of stages 40, and a part of the banknote storage bag 34 held by the holding members 36 extends downward from each stage 40 through the gap. Note that each stage 40 is driven by a stage driving unit 41 (see FIG. 11) such as an electric actuator.

As shown in FIG. 2, each stage 40 is provided with a heating member 42, Before the banknote storage bag 34 is taken out from the banknote storage mechanism 32, one stage 40 (for example, the stage 40 on the left side in FIG. 2) is moved toward the other stage 40 (for example, the stage 40 on the right side in FIG. 2) and the stages 40 come in contact with each other via the banknote storage bag 34. Then, the heating members 42 heat a portion of the banknote storage bag 34 near the bottom portion thereof, and the bottom portion of the banknote storage bag 34 is sealed by heat. In the banknote storage mechanism 32, instead of moving the one stage 40 of the pair of stages 40 toward the other stage 40, both stages 40 may move toward each other to the center position and the stages 40 may come in contact with each other at the center position.

As shown in FIG. 3, a pantograph 37 is attached to the left holding member 36 of the pair of left and right holding members 36. When the left holding member 36 is moved by the pantograph 37 toward the right holding member 36, the holding members 36 come in contact with each other. More specifically, a guide pin 36*b* is disposed at an end of the left holding member 36. In addition, a linear long hole 36*c* for guiding the guide pin 36*b* is formed in a frame 36*k* for supporting each holding member 36. Note that the long hole 36*c* is formed so as to extend in a horizontal direction in the frame 36*k*. When the pantograph 37 expands, the guide pin 36*b* disposed at the left holding member 36 is guided along the long hole 36*c*, whereby the left holding member 36 is moved toward the right holding member 36.

Further, as shown in FIG. 3, two pins 36*a* are respectively disposed on upper surfaces of the left and right holding members 36. As shown in FIG. 4, a pair of protrusions 34*a* each having two openings 34*b* is disposed at a location near the opening of the banknote storage bag 34 to be held by the holding members 36 (that is, an upper end of the banknote storage bag 34). When the banknote storage bag 34 is held by the holding members 36, each pin 36*a* of each holding member 36 passes through each opening 34*b* formed in each protrusion 34*a* of the banknote storage bag 34. As a result, these protrusions 34*a* are held by the holding members 36.

As shown in FIG. 2, a pushing unit 46 is disposed above the pair of temporary storage units 44. The pushing unit 46 is provided with a pantograph 50 (see FIGS. 7 to 10, not shown in FIG. 2), and the pushing unit 46 can be moved in the vertical direction within a range indicated by the arrow in FIG. 2 by the pantograph 50 expanding and contracting in the vertical direction in FIG. 2. When the banknotes temporarily held by the temporary storage units 44 are stored in the banknote storage bag 34, by moving the pushing unit 46 downward, it is possible to push the banknotes remaining on the temporary storage units 44 toward the banknote storage bag 34 in a stacked state.

A configuration of the pushing unit 46 will be described in detail with reference to FIGS. 5 and 6. Each of FIGS. 5 and 6 is a side view of the configuration of the pushing unit 46, the pair of temporary storage units 44, and the like in the banknote storage mechanism 32 shown in FIG. 2. FIG. 5 illustrates a state where no banknote is held on the temporary storage unit 44. FIG. 6 illustrates a state where the banknotes are held on the temporary storage unit 44 in a full state or nearly full state.

As shown in FIGS. 5 and 6, the pushing unit 46 includes a pushing member 46*a* and a base member 46*b*. The pushing member 46*a* can swing about a shaft 46*c* with respect to the base member 46*b*. More specifically, the pushing member 46*a* has an arc-shaped guide hole 46*f*, and the base member 46*b* has a pin member 46*g* to be inserted into the guide hole 46*f* of the pushing member 46*a*. The pushing member 46*a* swings about the shaft 46*c* with respect to the base member 46*b* in a range in which the pin member 46*g* moves relative to the guide hole 46*f*. In a case where no force is applied to the pushing member 46*a*, the pushing member 46*a* is maintained so as to protrude downward relative to the base member 46*b* due to its own weight as shown in FIG. 5. Meanwhile, when the pushing member 46*a* is pressed upward by the banknotes held on each temporary storage unit 44, the pushing member 46*a* in a state shown in FIG. 5 rotates about the shaft 46*c* in the counterclockwise direction in FIG. 5, and the pushing member 46*a* retracts upward relative to the base member 46*b* as shown in FIG. 6.

As shown in FIGS. 5 and 6, a detection member 46*d* is mounted to the upper portion of the pushing member 46*a*, and a detection sensor 47 for detecting the detection member 46*d* is disposed. The detection sensor 47 is fixedly positioned. In a case where the pushing unit 46 is positioned as shown in FIGS. 5 and 6, when the pushing member 46*a* is pressed upward by the banknotes held on each temporary storage unit 44, and the pushing member 46*a* rotates about the shaft 46*c* in the counterclockwise direction in FIGS. 5 and 6, the detection member 46*d* mounted to the pushing member 46*a* is detected by the detection sensor 47. Thus, the detection sensor 47 detects that the pushing member 46*a* rotates about the shaft 46*c* upward relative to the base member 46*b*. The detection sensor 47 may not be fixedly positioned. In another example, the detection sensor 47 and the pushing unit 46 may integrally move in the up-down direction in FIG. 2. In this case, also when the pushing unit 46 moves into the banknote storage bag 34 so as to push the banknotes on each temporary storage unit 44 into the banknote storage bag 34 as shown in FIG. 2, it can be detected that the pushing member 46*a* is pushed upward by the banknotes stored in the banknote storage bag 34 and the pushing member 46*a* rotates upward about the shaft 46*c*.

In the present embodiment, the pushing unit 46 functions as an entering unit configured to enter into the banknote storage bag 34 held by the pair of holding members 36.

The pushing unit 46 functions also as a guide for guiding a banknote when the banknote sent from the banknote sending unit 48 is stored on each temporary storage unit 44. When each temporary storage unit 44 is in a full state or nearly full state of the banknotes, the pushing member 46*a* of the pushing unit 46 is pushed upward, and the detection member 46*d* is detected by the detection sensor 47. That is, when each temporary storage unit 44 is in a full state or nearly full state of the banknotes, the detection sensor 47 detects that the temporary storage unit 44 is in a full state or nearly full state of the banknotes.

Next, a mechanism for moving the pushing unit 46 downward and a mechanism for rotating the pair of temporary storage units 44 downward in the banknote storage mechanism 32 according to the present embodiment will be described with reference to FIGS. 7 to 10. In the banknote storage mechanism 32 according to the present embodiment, one motor 54 (see FIGS. 8 and 9) is used to simultaneously perform an operation of moving the pushing unit 46 downward and an operation of rotating the pair of temporary storage units 44 downward.

As shown in FIG. 7, a mounting member 46*e* is mounted to the upper surface of the base member 46*b* of the pushing unit 46, and two lower end portions of the pantograph 50 are mounted to the mounting member 46*e*. One of the two lower end portions of the pantograph 50 is mounted so as to be rotatable relative to the mounting member 46*e*, whereas the other of the two lower end portions has a pin member, and the pin member is moved in the horizontal direction in a long hole formed in the mounting member 46*e*. Furthermore, one of two upper end portions of the pantograph 50 has a shaft 51 mounted thereto, and the upper end portion rotates about the shaft 51. The other of the two upper end portions of the pantograph 50 is rotatably mounted to a rack 52 that is moved in the horizontal direction by a pinion 68 as described below (see FIG. 9). When the rack 52 is moved by the pinion 68 so as to be close to the shaft 51, the pantograph 50 expands downward, whereby the pushing unit 46 mounted to the lower end portion of the pantograph 50 is also moved downward. Meanwhile, when the rack 52 is moved by the pinion 68 so as to be distant from the shaft 51, the pantograph 50 contracts upward, whereby the pushing unit 46 mounted to the lower end portion of the pantograph 50 is also moved upward.

Next, a configuration of the motor 54 and the like for simultaneously performing the operation of moving the pushing unit 46 downward and the operation of rotating the pair of temporary storage units 44 downward will be described with reference to FIGS. 8 to 10. As shown in FIG. 8, a gear 55 is mounted to the motor 54, and both forward rotation and reverse rotation of the gear 55 are performed by the motor 54. The gear 55 mounted to the motor 54 meshes with another gear 56. The gear 56 further meshes with another gear 57. A pulley 58 over which an endless belt 60 is extended is disposed at the rotating shaft of the gear 57, and the gear 57 and the pulley 58 rotate in synchronization with each other. A torque limiter 59 is disposed at the rotating shaft of the gear 57. When an excessive torque higher than a predetermined torque is applied between the rotating shaft and the pulley 58, the rotating shaft and the pulley 58 are disconnected from each other and the rotating shaft rotates relative to the pulley 58 in an idling state. The endless belt 60 is extended also over another pulley 62. Furthermore, as shown in FIG. 9, another gear 63 is mounted to the rotating shaft of the pulley 62, and the pulley 62 and the gear 63 rotate in synchronization with each other. The gear 63 meshes with another gear 64, and the gear 64 rotates about a rotating shaft 66. In such a configuration, when forward rotation and reverse rotation of the gear 55 are performed by the motor 54, the rotating shaft 66 performs forward rotation and the reverse rotation.

As shown in FIG. 9, the pinion 68, a cam 70, and a detection plate 75 are mounted to the rotating shaft 66. When the rotating shaft 66 rotates, the pinion 68, the cam 70, and the detection plate 75 also rotate about the rotating shaft 66. As described above, when the pinion 68 rotates about the rotating shaft 66, the rack 52 is moved so as to be close to the shaft 51 or distant from the shaft 51, so that the pantograph 50 expands or contracts. As shown in FIG. 9, near the cam 70, a power transmission member 72 for operating each temporary storage unit 44 is disposed. As shown in FIG. 9, the power transmission member 72 is an almost rectangular plate-like member. The power transmission member 72 is disposed so as to extend in the vertical direction. Near each of the lower end portions on both the side edges of the power transmission member 72, a teeth portion 72*a* is formed so as to linearly extend. A gear 45 is mounted to each of the shafts 44*a* of the pair of temporary storage units 44, and the gear 45 meshes with the teeth portion 72*a* of the power transmission member 72. Therefore, when the power transmission member 72 in the state shown in FIG. 9 moves downward, the teeth portions 72*a* rotate the gears 45, respectively, so that each temporary storage unit 44 opens downward about the shaft 44*a*. In a case where no force is applied to the power transmission member 72, the power transmission member 72 is drawn upward by a not-illustrated tension spring or the like. A roller 73 is rotatably mounted to the power transmission member 72, and the outer circumferential surface of the roller 73 is brought into contact with the outer circumferential surface of the cam 70. When the cam 70 rotates about the rotating shaft 66 in the clockwise direction in FIG. 8, the roller 73 is pushed downward by the outer circumferential surface of the cam 70, so that the power transmission member 72 moves downward against a drawing force due to the above-described tension spring or the like. When the power transmission member 72 thus moves downward, the teeth portions 72*a* rotate the gears 45, as described above, so that each temporary storage unit 44 opens downward about the shaft 44*a*.

As shown in FIGS. 9 and 10, near the rotating shaft 66, two sensors (specifically, an upper end detection sensor 76 and a lower end detection sensor 78) for detecting the detection plate 75 mounted to the rotating shaft 66 are disposed. More specifically, when the pantograph 50 fully contracts, and the pushing unit 46 is located at the upper end position (retracting position), the detection plate 75 is detected by the upper end detection sensor 76. When the pantograph 50 fully expands, and the pushing unit 46 is located at the lower end position, the detection plate 75 is detected by the lower end detection sensor 78. Thus, the upper end detection sensor 76 and the lower end detection sensor 78 detect that the pushing unit 46 is located at the upper end position (retracting position) and the lower end position, respectively.

In the banknote storage mechanism 32 of the present embodiment, a stage position detector 79 for detecting a position of each stage 40 in the vertical direction is disposed. Specifically, a detection plate (not shown) is mounted to each stage 40. The stage position detector 79 has a line sensor extending in the vertical direction for detecting the detection plate. Then, as the detection plate mounted to each stage 40 is detected by the line sensor, the position of each stage 40 in the vertical direction is detected by the stage position detector 79.

The banknote handling machine 10 of the present embodiment has a controller 80 that controls the components of the banknote handling machine 10. More specifically, as shown in FIG. 11, the banknote feeding mechanism 20*a* disposed at the inlet unit 20, a stacking wheel driving unit 22*b* for driving the stacking wheel 22*a* disposed at the outlet unit 22, the transporting unit 24, the diverged transporting unit 25, the recognition unit 26, the storage/feeding unit 30, the banknote storage mechanism 32 (specifically, the pantograph 37, the heating member 38, the stage driving unit 41, the heating member 42, the detection sensor 47, the motor 54, the upper end detection sensor 76, the lower end detection sensor 78, the stage position detector 79, and the banknote sending unit 48), and the like, are connected to the controller 80. A signal representing a result of recognition of a banknote by the recognition unit 26 is transmitted to the controller 80, and the controller 80 controls operations of the components by transmitting an instruction signal to each component of the banknote handling machine 10. Detection information by the detection sensor 47, the upper end detection sensor 76, the lower end detection sensor 78, and the stage position detector 79 is also transmitted to the controller 80.

As shown in FIG. 11, an operation/display unit 82, a memory unit 84, a printing unit 86, and a communication interface unit 88 are connected to the controller 80. As shown in FIG. 1, the operation/display unit 82 is implemented by, for example, a touch panel disposed on the upper surface of the housing 12, and the operation/display unit 82 displays information on, for example, a state of handling such as depositing of banknotes in the banknote handling machine 10, and an inventory amount of banknotes stored in each banknote storage bag 34. When an operator operates the operation/display unit 82, various instructions can be provided to the controller 80. The memory unit 84 stores information on, for example, a history of handling such as depositing of banknotes in the banknote handling machine 10, and an inventory amount of banknotes stored in each banknote storage bag 34. The printing unit 86 prints, on a receipt or the like, information on, for example, a history of handling such as depositing of banknotes in the banknote handling machine 10 and an inventory amount of banknotes stored in each banknote storage bag 34. The controller 80 can transmit a signal to and receive a signal from an external device (specifically, for example, higher-ranking terminal) disposed separately from the banknote handling machine 10 of the present embodiment, through the communication interface unit 88. Specifically, the controller 80 can transmit information stored in the memory unit 84 through the communication interface unit 88 to the external device which is disposed separately from the banknote handling machine 10. For example, when the banknotes together with the banknote storage bag 34 are collected by, for example, a guard of a cash-in-transit company, the information on the collected banknotes is transmitted to, for example, a computer of the cash-in-transit company through the communication interface unit 88.

Next, an operation of the banknote handling machine 10 having such a configuration will be described. The operation of the banknote handling machine 10 as described below is performed by the controller 80 controlling the components of the banknote handling machine 10.

Firstly, an operation of depositing of banknotes in the banknote handling machine 10 will be described. An operator inserts banknotes in the inlet unit 20 and then provides the controller 80 with an instruction for starting the depositing through the operation/display unit 82. Then, the banknotes inserted in the inlet unit 20 are fed out into the housing 12 one by one by the banknote feeding mechanism 20*a*, and transported one by one by the transporting unit 24. The recognition unit 26 performs recognition of denomination, authentication, face/back, fitness, new/old, transport state, and the like for the banknote transported by the transporting unit 24. A banknote recognized as being not normal by the recognition unit 26, that is, a rejected banknote is transported to the outlet unit 22 by the transporting unit 24, and stacked in the outlet unit 22. Thus, the operator is allowed to manually take out the rejected banknotes stacked in the outlet unit 22 from the front surface of the housing 12, and, for example, to insert again the banknotes in the inlet unit 20. Meanwhile, a banknote recognized as being normal by the recognition unit 26 is transported to the storage/feeding unit 30, and temporarily stored in the storage/feeding unit 30. The number of banknotes for each denomination temporarily stored in the storage/feeding unit 30 and the total monetary amount thereof are displayed on the operation/display unit 82. When the operator confirms the displayed contents, and performs an operation of confirming the depositing, banknotes are fed out one by one from the storage/feeding unit 30 to the transporting unit 24, are diverted from the transporting unit 24 to the diverged transporting unit 25, are transported from the diverged transporting unit 25 to the banknote storage bag 34, and are stored in the banknote storage bag 34.

When the banknote storage bag 34 to which the banknote recognized by the recognition unit 26 is to be transported is in a full state or nearly full state, and the banknote cannot be stored in the banknote storage bag 34, the storage/feeding unit 30 may be used as a storage unit for storing banknotes until the full state or nearly full state is eliminated. Specifically, the banknotes recognized by the recognition unit 26 are transported to the storage/feeding unit 30, and stored in the storage/feeding unit 30. The banknote storage bag 34 in the full state or nearly full state is taken out from the banknote storage mechanism 32 of the lower assembly 16 by a guard of a cash-in-transit company, a clerk of the store, or the like, and the empty banknote storage bag 34 is mounted to the banknote storage mechanism 32, and banknotes are then fed out one by one from the storage/feeding unit 30 to the transporting unit 24, and transported to the banknote storage bag 34 by the transporting unit 24.

Next, an operation of storing a banknote transported from the diverged transporting unit 25 of the upper assembly 14 to the lower assembly 16, in the banknote storage bag 34 held by the pair of holding members 36, in the banknote storage mechanism 32, will be described.

The banknote transported from the diverged transporting unit 25 of the upper assembly 14 to the lower assembly 16 is sent onto the pair of left and right temporary storage units 44 by the banknote sending unit 48, and stacked on the temporary storage units 44. When a predetermined number of banknotes are stacked on the temporary storage units 44, each temporary storage unit 44 rotates about the shaft 44*a* disposed at the proximal end portion in the downward direction (that is, the directions indicated by the arrows in FIG. 2), and the banknotes stacked on the temporary storage units 44 fall from the temporary storage units 44 due to their own weight, and are stored in the banknote storage bag 34. Specifically, the motor 54 rotates the gear 55, to rotate the rotating shaft 66, and the cam 70 mounted to the rotating shaft 66 rotates, whereby the power transmission member 72 moves downward. When the power transmission member 72 moves downward, each gear 45 is rotated by the teeth portion 72*a* disposed at the power transmission member 72, so that each temporary storage unit 44 opens downward about the shaft 44*a*. When the motor 54 rotates the gear 55 to rotate the rotating shaft 66, the pinion 68 rotates, and the rack 52 is moved by the pinion 68 so as to be close to the shaft 51. Thus, the pantograph 50 expands downward, and the pushing unit 46 mounted to the lower end portion of the pantograph 50 is also moved downward. Thus, when the banknotes temporarily stored on the temporary storage units 44 are stored in the banknote storage bag 34, banknotes having been left on the temporary storage units 44 can be pushed toward the banknote storage bag 34 by the pushing unit 46.

When banknotes fall from the temporary storage units 44, and are stored in the banknote storage bag 34, each stage 40 is moved downward by the stage driving unit 41, and a space for subsequently storing banknotes sent to the banknote storage bag 34 from the temporary storage units 44 is formed in the banknote storage bag 34. Further, in the present embodiment, after banknotes are stored in the banknote storage bag 34 held by each holding member 36 and each stage 40 is moved downward, the pushing unit 46 may enter into the banknote storage bag 34 so that the bottom of the banknote storage bag 34 is pushed toward each stage 40 by the pushing unit 46 via the banknotes stacked in the banknote storage bag 34. In this case, by pushing the banknotes into the banknote storage bag 34 by the pushing unit 46, the banknotes stored in a stacked state inside the banknote storage bag 34 are compressed in the stacking direction. Therefore, it is possible to further prevent the banknotes stored in the banknote storage bag 34 from collapsing.

In the present embodiment, the controller 80 detects the upper end position of the banknotes stored in the banknote storage bag 34 by causing the pushing unit 46 to enter into the banknote storage bag 34 held by each holding member 36 and bringing the pushing unit 46 into contact with the banknotes stored in the banknote storage bag 34. In addition, the controller 80 controls each component so as to maintain the upper end position of the banknotes stored in the banknote storage bag 34 held by each holding member 36 at a predetermined height. More specifically, when the pushing unit 46 enters into the banknote storage bag 34 held by each holding member 36 and the pushing unit 46 is brought into contact with the banknotes stored in the banknote storage bag 34, the controller 80 controls the stage driving unit 41 to move each stage 40 downward when it is not detected by the lower end detection sensor 78 that the pushing unit 46 is located at the lower end position. Details of such operation will be described below.

As described above, when the banknotes temporarily held on the temporary storage units 44 are stored in the banknote storage bag 34, the banknotes stacked on the temporary storage units 44 are pushed toward the banknote storage bag 34 by the pushing unit 46 in a stacked state. However, since each banknote stored in the banknote storage bag 34 has a thickness, the pushing unit 46 can not move to the lower end position, and an excessive torque exceeding a predetermined torque is applied between the rotating shaft of the gear 57 and the pulley 58. In this case, the connection between the rotating shaft and the pulley 58 is cut off by the torque limiter 59, and the rotating shaft idles with respect to the pulley 58. Also, since the pushing unit 46 can not move to the lower end position, the detection plate 75 is not detected by the lower end detection sensor 78. As a result, the controller 80 detects that the pushing unit 46 is not located at the lower end position.

If the lower end detection sensor 78 does not detect that the pushing unit 46 is located at the lower end position even after a certain period of time after rotating the motor 54 to move the pushing unit 46 downward, the controller 80 controls the stage driving unit 41 to move each stage 40 downward. As a result, the bottom of the banknote storage bag 34 held by the pair of holding members 36 is also moved downward, so that the banknotes stored in the banknote storage bag 34 are also moved downward and then the pushing unit 46 is also moved downward. In this way, as the pushing unit 46 is moved downward and the pushing unit 46 reaches the lower end position, the lower end detection sensor 78 detects the detection plate 75. As a result, the lower end detection sensor 78 detects that the pushing unit 46 is located at the lower end position. When the lower end detection sensor 78 detects that the pushing unit 46 is located at the lower end position, the controller 80 controls the stage driving unit 41 to stop moving each stage 40 downward. In this manner, the upper end position of the banknotes stored in the banknote storage bag 34 held by each holding member 36 can be maintained at a predetermined height (that is, the upper end position of the banknotes is maintained at a position of the lower surface of the pushing member 46*a* of the pushing unit 46 when the pushing unit 46 is located at the lower end position).

In the present embodiment, the controller 80 can not only detect the upper end position of the banknotes stored in the banknote storage bag 34 held by each holding member 36, but also detect the height of the banknotes stored in the banknote storage bag 34. Note that the height of the banknotes is the total height of a plurality of banknotes stored in the banknote storage bag 34 in a stacked state. More specifically, as described above, the position of each stage 40 in the vertical direction is detected by the stage position detector 79. Then, the controller 80 detects the height of the banknotes stored in the banknote storage bag 34 based on the upper end position of the banknotes stored in the banknote storage bag 34 detected by the controller 80 and the position of each stage 40 (that is, the position of the bottom of the banknote storage bag 34 in the vertical direction) detected by the stage position detector 79. In this manner, when the height of the banknotes stored in the banknote storage bag 34 is detected, it is possible to prevent the banknote located at the top of the banknotes stored in the banknote storage bag 34 from being caught between the pair of heating members 38 when the opening of the banknote storage bag 34 is sealed by heat by the pair of heating members 38.

As described above, according to the banknote storage mechanism 32 (banknote storage apparatus) of the present embodiment and the banknote storage method performed by such a banknote storage mechanism 32, the pushing unit 46 is provided as an entering unit capable of entering into the banknote storage bag 34 held by the pair of holding members 36, and the motor 54 is provided as a driving unit for driving the pushing unit 46. Further, the controller 80 for controlling the motor 54 advances the pushing unit 46 into the banknote storage bag 34 held by the pair of holding members 36 to physically bring the pushing unit 46 into contact with the banknotes stored in the banknote storage bag 34 to detect the upper end position of the banknotes stored in the banknote storage bag 34. In such a case, by physically bringing the pushing unit 46 into contact with the banknotes stored in the banknote storage bag 34, it is possible to reliably detect the upper end position of the banknotes. Therefore, when the opening of the banknote storage bag 34 is sealed by heat by the pair of heating members 38, occurrence of an unsealed portion in the opening of the banknote storage bag 34 can be prevented.

Note that the banknote storage mechanism (banknote storage apparatus) and the banknote storage method according to the present embodiment are not limited to the above-described aspects, and various modifications can be made.

For example, in the above description, an aspect in which the lower end detection sensor 78 is used as a first detector for detecting whether or not the pushing unit 46 as the entering unit is located at the lower end position (that is, the lower end position in which the pushing unit 46 enters into the banknote storage bag 34 held by each holding member 36) has been described. However, when detecting whether the pushing unit 46 is located at the lower end position, a method other than the method of detecting the detection plate 75 by the lower end detection sensor 78 may be used. As another method of detecting whether the pushing unit 46 is located at the lower end position, it can be used a method of using the operation of the pushing member 46*a* of the pushing unit 46 when the pushing member 46*a* is brought into contact with the banknotes stored in the banknote storage bag 34. Specifically, the detection sensor 47 for detecting the detection member 46*d* mounted to the upper portion of the pushing member 46*a* is configured to move in the vertical direction in FIG. 2 integrally with the pushing unit 46. When the pushing member 46*a* of the pushing unit 46 is brought into contact with the banknotes stored in the banknote storage bag 34 and there is room for the pushing unit 46 to move further downward, the pushing member 46*a* is pushed by the banknotes to rotate, and the detection sensor 47 detects the detection member 46*d*. At this time, the controller 80 determines that the pushing unit 46 has not yet reached the lower end position. On the other hand, when the pushing member 46*a* of the pushing unit 46 is brought into contact with the banknotes stored in the banknote storage bag 34, if the pushing unit 46 has reached the lower end position, the pushing member 46*a* hardly rotates and the detection sensor 47 does not detect the detection member 46*d*. At this time, the controller 80 determines that the pushing unit 46 is located at the lower end position. When the pushing member 46*a* of the pushing unit 46 is brought into contact with the banknotes stored in the banknote storage bag 34, if the detection member 46*d* is detected by the detection sensor 47, the controller 80 controls the stage driving unit 41 to lower each stage 40 until the detection sensor 47 no longer detects the detection member 46*d*. Thus, the pushing unit 46 can be positioned at the lower end position.

In addition, instead of detecting the upper end position (standby position) and the lower end position of the pushing unit 46 by using two sensors (specifically, the upper end detection sensor 76 and the lower end detection sensor 78) for detecting the detection plate 75 mounted to the rotating shaft 66 of the pinion 68, a detection plate may be mounted to the shaft 51 provided at the upper end portion of the pantograph 50 and two detection sensors for detecting this detection plate may be disposed. More specifically, when the pantograph 50 is in a completely contracted state and the pushing unit 46 is positioned at the upper end position (standby position), the detection plate mounted to the shaft 51 is detected by the first detection sensor. On the other hand, when the pantograph 50 is in a fully expanded state and the pushing unit 46 is located at the lower end position, the detection plate mounted to the shaft 51 is detected by the second detection sensor. In this manner, the two detection sensors for detecting the detection plate mounted to the shaft 51 respectively detect that the pushing unit 46 is positioned at the upper end position (standby position) and the lower end position. Even with such a configuration, by detecting the lower end position of the pushing unit 46, the position in the vertical direction of the pushing unit 46 that contacts the banknotes stored in the banknote storage bag 34 can be set as the lower end position. Therefore, the upper end position of the banknotes stored in the banknote storage bag 34 can always be the same height level.

Figure 12:
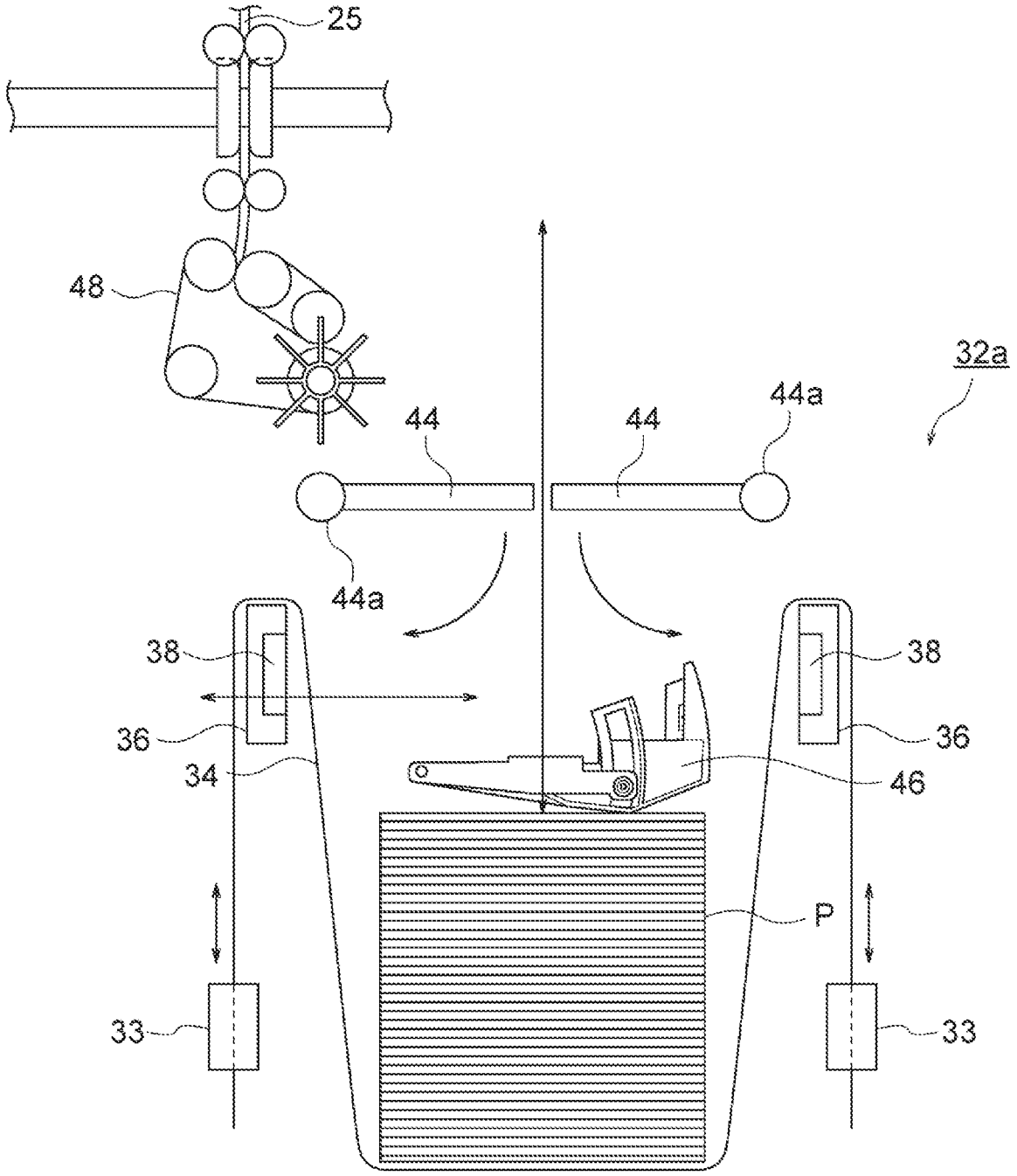
FIG. 12 is a side view showing a configuration of a banknote storage mechanism according to a modified example.

As a banknote storage mechanism according to a modified example, one having a configuration as shown in FIG. 12 may be used. In a banknote storage mechanism 32*a* shown in FIG. 12, unlike the banknote storage mechanism 32 shown in FIG. 2 and the like, each holding member 36 is not provided with the pins 36*a* for holding the banknote storage bag 34. In the banknote storage mechanism 32*a* shown in FIG. 12, the banknote storage bag 34 is folded downward at each holding member 36 and a portion of the banknote storage bag 34 in the vicinity of the opening thereof is held by a storage bag position adjuster 33 to be described later. Further, in the banknote storage mechanism 32*a* shown in FIG. 12, unlike the banknote storage mechanism 32 shown in FIG. 2 and the like, the stages 40 on which the bottom of the banknote storage bag 34 held by the storage bag position adjuster 33 is placed are not provided. In the banknote storage mechanism 32*a* shown in FIG. 12, the storage bag position adjuster 33 can move the banknote storage bag 34 held by the storage bag position adjuster 33 in the vertical direction (that is, the direction indicated by the arrow in FIG. 12). As a result, the storage bag position adjuster 33 can move the position of the bottom of the banknote storage bag 34 in a substantially vertical direction.

In the banknote storage mechanism 32*a* as shown in FIG. 12, when the pushing unit 46 as the entering unit enters into the banknote storage bag 34 and the pushing unit 46 is brought into contact with the banknotes stored inside the banknote storage bag 34, the controller 80 controls the storage bag position adjuster 33 so as to lower the position of the bottom of the banknote storage bag 34 if it is not detected by the lower end detection sensor 78 as the first detector that the pushing unit 46 is located at the lower end position. Thus, even in the banknote storage mechanism 32*a* as shown in FIG. 12, the upper end position of the banknotes stored in the banknote storage bag 34 can always be at the same height level, since the position in the vertical direction of the pushing unit 46 in contact with the banknotes stored in the banknote storage bag 34 can be set as the lower end position.

Further, in the banknote storage mechanism according to another modified example, the inside of one banknote storage bag 34 may be divided into a plurality of banknote storage spaces so that the banknotes can be stored in a stacked state in each banknote storage space. The operation of storing the banknotes in the banknote storage bag 34 by the banknote storage mechanism according to another modified example will be described with reference to FIG. 13.

Figure 13:
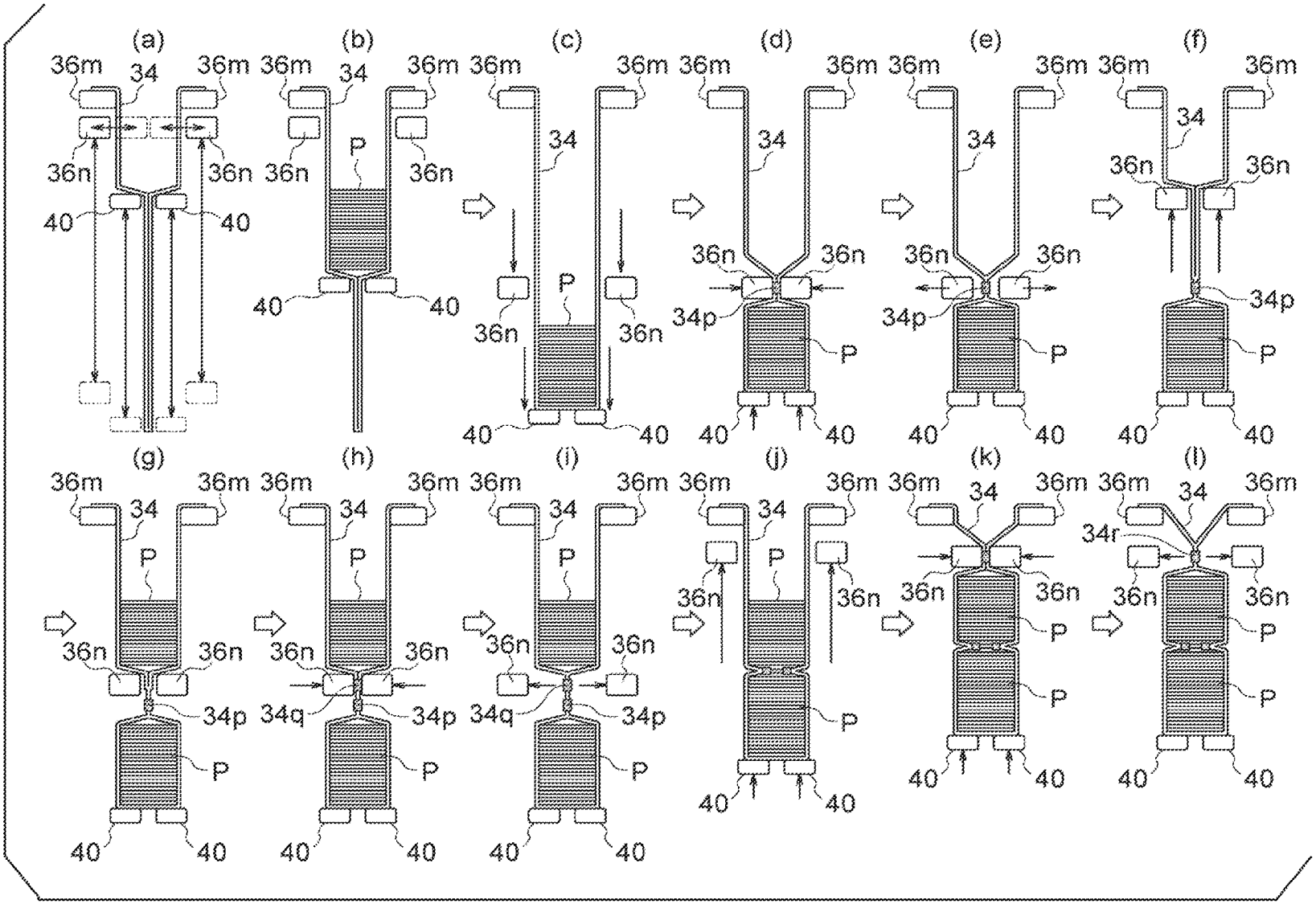
FIG. 13 is an explanatory view showing an operation of storing banknotes in the banknote storage bag by the banknote storage mechanism according to another modified example.

In a banknote storage mechanism according to another modified example as shown in FIG. 13, a pair of first holding members 36*m* for holding two opposed portions of the banknote storage bag 34 in the vicinity of the opening thereof, and a pair of second holding members 36*n* provided under each first holding member 36*m* and movable in the direction of the arrow in FIG. 13 (*a*) are provided, respectively, instead of the pair of holding members 36 each having the heating member 38. Each first holding member 36*m* is arranged in a fixed position, and these first holding members 36*m* are not provided with a heating member. On the other hand, in each second holding member 36*n*, a heating member having the same configuration as that of the above-described heating member 38 is provided. Each of the second holding members 36*n* is movable in directions toward and away from each other, respectively, and is movable in the vertical direction.

When the banknotes are stored in the banknote storage bag 34 by the banknote storage mechanism according to the modified example as shown in FIG. 13, firstly, as shown in FIG. 13 (*a*), two opposed portions of the banknote storage bag 34 in the vicinity of the opening thereof are held by each first holding member 36*m* provided in a fixed position. Next, as shown in FIG. 13 (*b*), banknotes are stored in the banknote storage bag 34 in a stacked state. At this time, each time banknotes are stored in the banknote storage bag 34, each stage 40 is gradually lowered. Then, when a predetermined number of banknotes are stored in the banknote storage bag 34, each stage 40 is moved to the lower end position as shown in FIG. 13 (*c*). Further, each second holding member 36*n* is moved to an intermediate position in the height direction of the banknote storage bag 34. Thereafter, as shown in FIG. 13 (*d*), each second holding member 36*n* is moved in a direction to approach each other so that the banknote storage bag 34 is sandwiched between the second holding members 36*n*. As a result, as heat is applied to the intermediate portion of the banknote storage bag 34 in the height direction of the banknote storage bag 34 by the heating member, the intermediate portion of the banknote storage bag 34 is sealed by heat. In FIG. 13 (*d*), the portion of the banknote storage bag 34 sealed by heat for the first time by the heating member is indicated by reference numeral 34*p*. In this way, by sealing the portion of the intermediate position of the banknote storage bag 34 by heat, it is possible to divide the inside of one banknote storage bag 34 into a plurality of banknote storage spaces.

Thereafter, as shown in FIG. 13 (*e*), each second holding member 36*n* is slightly moved in a direction to separate from each other so as to form a gap between these second holding members 36*n*. Further, as shown in FIG. 13 (*f*), each second holding member 36*n* is raised. At this time, a part of the banknote storage bag 34 held by each first holding member 36*m* extends downward from the second holding members 36*n* through a gap between the second holding members 36*n*. Further, the banknote storage bag 34 is placed on the second holding members 36*n*, and the banknotes stored in a stacked state in the banknote storage bag 34 are placed on each second holding member 36*n*.

Then, as shown in FIG. 13 (*g*), in the banknote storage bag 34, banknotes are stored in a stacked state above the sealed portion 34*p* by heat. At this time, each time banknotes are stored in the banknote storage bag 34, each stage 40 is gradually lowered. Then, when a predetermined number of banknotes are stored in the banknote storage bag 34, as shown in FIG. 13 (*h*), each second holding member 36*n* is moved toward each other and the banknote storage bag 34 is sandwiched by the second holding members 36*n*. As a result, as the heating member gives heat to the intermediate portion of the banknote storage bag 34 (specifically, the portion above the sealed portion 34*p* by heat for the first time by the heating members) in the height direction of the banknote storage bag 34, the intermediate position of the banknote storage bag 34 is sealed by heat. In FIG. 13 (*h*), the portion of the banknote storage bag 34 sealed by heat for the second time by the heating members is indicated by reference numeral 34*q*. As a result, when the portion between the sealed portion 34*p* sealed by heat for the first time and the sealed portion 34*q* sealed by heat for the second time in the banknote storage bag 34 is cut, it is possible to form two banknote storage bags, each with banknotes stored in a stacked state. Note that the operation of sealing the banknote storage bag 34 by heat for the second time by the heating members as shown in FIG. 13 (*h*) can be omitted.

Then, when the operation of sealing the banknote storage bag 34 by heat for the second time by the heating members is completed, each second holding member 36*n* is moved in a direction to separate from each other as shown in FIG. 13 (*i*). Thereafter, as shown in FIG. 13 (*j*), each second holding member 36*n* is further raised. Specifically, each second holding member 36*n* is raised to a position near the opening of the banknote storage bag 34. Then, as shown in FIG. 13 (*k*), in the vicinity of the opening of the banknote storage bag 34, each second holding member 36*n* is moved toward each other and the banknote storage bag 34 is sandwiched by the second holding members 36*n*. As a result, as heat is applied to the portion of the banknote storage bag 34 near the opening thereof by the heating member, this portion of the banknote storage bag 34 is sealed by heat. In FIG. 13 (*k*), the portion of the banknote storage bag 34 sealed by heat for the third time by the heating members is indicated by reference numeral 34*r*. Thereafter, each second holding member 36*n* is moved in a direction to separate from each other as shown in FIG. 13 (*l*). In this way, it is possible to divide the inside of one banknote storage bag 34 into the plurality of banknote storage spaces and banknotes can be stored in a stacked state in each banknote storage space.

In the above description, an embodiment is described in which the inside of one banknote storage bag 34 is divided into two banknote storage spaces, and banknotes are stored in a stacked state in each of the two banknote storage spaces. However, in the case of dividing the inside of one banknote storage bag 34 into three or more banknote storage spaces and banknotes are stored in a stacked state in each of three or more banknote storage spaces, a plurality of intermediate portions in the height direction of the banknote storage bag 34 can be sealed by heat by the same method as shown in FIG. 13 (*a*) to (*l*).

In addition, the intermediate portion in the height direction of the banknote storage bag 34 may be sealed by heat by using the heating members 42 provided in each stage 40, instead of sealing the intermediate portion in the height direction of the banknote storage bag 34 by heat by using heating members provided in each second holding member 36*n*. In this case, in addition to each stage 40 that is movable in the vertical direction, an additional fixed stage provided at a fixed position in the vicinity of the bottom of the banknote storage bag 34 held by each holding member 36 may be arranged. In addition, each stage 40 provided with the heating member 42 is made movable in the vertical direction as well as movable in a direction approaching each other and in a direction moving away from each other. In such a case, by replacing the operation of each second holding member 36*n* in each of FIG. 13 (*c*) to (*l*) with the operation of each stage 40, it is possible to seal the intermediate portion in the height direction of the banknote storage bag 34 by using the heating members 42 provided with each stage 40.

In addition, when dividing the inside of one banknote storage bag 34 into a plurality of banknote storage spaces and banknotes are stored in a stacked state in each banknote storage space, the banknotes may be stored in each banknote storage space for each denomination. Further, it is also possible to store fit banknotes in one banknote storage space and store unfit banknotes in the other banknote storage space.

In a banknote storage mechanism according to still another modified example, when the portion of the banknote storage bag 34 in the vicinity of the opening thereof is sealed by heat by the heating members 38, it may be designed to print characters, designs and the like at the sealed portion by heat in the banknote storage bag 34. Specifically, instead of providing the heating members 38 in each holding member 36, one heating member 38 is provided with one holding members 36 and an elastic member such as silicone rubber is provided with the other holding member 36, and characters, designs and the like to be printed on the banknote storage bag 34 are formed on this elastic member. The elastic member provided with the other holding member 36 is disposed at a position opposed to the heating member 38 provided with the one holding member 36. When sealing the portion of the banknote storage bag 34 near the opening thereof is sealed by heat by the heating members 38, characters, designs and the like formed on the elastic member opposed to the heating members 38 are transferred to the banknote storage bag 34. Thus, after a malicious operator who took out the banknote storage bag 34 from the banknote storage mechanism opens the banknote storage bag 34 and steels a part of the stored banknotes, illegal act such as resealing the portion of the banknote storage bag 34 near the opening thereof with an iron or a commercially available sealing apparatus can be prevented.

In the banknote storage mechanism according to such a still another modified example, characters, designs and the like printed on the banknote storage bag 34 for preventing illegal act as described above may be variable. For example, a movable variable character part is disposed at the elastic member such as silicone rubber provided with the other holding member 36. Further, characters, designs and the like to be printed on the banknote storage bag 34 may be made as special characters or special designs. In addition, numbers, characters and the like as encryption may be printed on the banknote storage bag 34.

Regarding characters, designs and the like to be printed on the banknote storage bag 34, the manner in which characters, designs and the like are printed may be changed depending on the temperature to be sealed by heat. For example, the manner in which the pattern (for example, diagonal line) of the portion sealed by heat on the banknote storage bag 34 rises may be changed depending on the temperature of heat by the heating members 38. In this case, unless the portion of the banknote storage bag 34 near the opening thereof is heated at a correct temperature, the characters, designs and the like printed on the banknote storage bag 34 are not correctly displayed. Further, information on the temperature to be sealed by heat may be pre-printed on the banknote storage bag 34, for example, as a two-dimensional barcode. In this case, after reading the two-dimensional barcode by a scanner and selecting the temperature obtained from the two-dimensional barcode out of the plurality of preset temperatures in the banknote storage mechanism, the portion of the banknote storage bag 34 near the opening thereof is sealed by heat by the heating members 38. In such a way, it is possible to correctly display characters, designs and the like printed on the banknote storage bag 34.

Further, the sheet storage mechanism according to the present invention is not limited to the banknote storage mechanism for storing the banknotes in the storage bag having the opening on one side thereof. A tubular storage bag having openings at both ends may be used. In this case, one opening may be used for inserting the banknotes, and the other opening may be sealed before the banknotes are stored in the storage bag or after the banknotes are stored in the storage bag. Further, as the sheet storage mechanism according to the present invention, one in which sheets (for example, checks, vouchers, and the like) other than the banknotes are stored in the storage bag may be used.

The invention claimed is:

1. A sheet storage apparatus for storing a sheet in a storage bag having an opening for inserting the sheet comprising:

a supporter configured to support a portion of the storage bag in the vicinity of the opening of the storage bag;

an entering unit configured to move between a predefined standby position which is a position above the storage bag supported by the supporter and a predefined lower end position where the entering unit is in the storage bag supported by the supporter;

a driving unit configured to move the entering unit from the standby position to the lower end position;

a first detector configured to detect whether or not the entering unit is located at the lower end position;

a platform configured to move in a substantially vertical direction and on which at least a part of the storage bag supported by the supporter is placed; and a controller configured to control the platform to move downward, when it is not detected by the first detector that the entering unit is located at the lower end position, such that an upper end position of the sheet stored in the storage bag supported by the supporter is maintained at a predetermined height.

2. The sheet storage apparatus according to claim 1, further comprising a stopping mechanism configured to stop the entering unit from moving toward the lower end position, when the entering unit comes in contact with the sheet stored in the storage bag before the entering unit reaches the lower end position.

3. The sheet storage apparatus according to claim 1, wherein the entering unit enters into the storage bag supported by the supporter and pushes the sheet stored in the storage bag downward.

4. The sheet storage apparatus according to claim 1, wherein the controller also detects a height of the sheet stored in the storage bag supported by the supporter.

5. The sheet storage apparatus according to claim 4, further comprising:

a second detector configured to detect a position of the platform, and wherein the controller detects the height of the sheet stored in the storage bag based on the position of the platform detected by the second detector.

6. The sheet storage apparatus according to claim 1, further comprising a pantograph configured to expand and contract in the vertical direction, wherein the entering unit is attached to the lower end of the pantograph, and the driving unit drives the pantograph to contract such that the entering unit is moved to the standby position and to expand such that the entering unit is moved to the lower end position.

7. The sheet storage apparatus according to claim 6, further comprising a torque limiter between the driving unit and the pantograph, wherein when an excessive torque higher than a predetermined torque is applied to the torque limiter, the driving unit and the pantograph are disconnected from each other.

8. The sheet storage apparatus according to claim 6, wherein the driving unit includes a motor, the first detector includes a detection plate configured to rotate in synchronization with the motor, an upper end detection sensor and a lower end detection sensor, when the pantograph fully contracts and the entering unit is located at the standby position, the detection plate is detected by the upper end detection sensor, and when the pantograph fully expands and the entering unit is located at the lower end position, the detection plate is detected by the lower end detection sensor.

9. A sheet storage apparatus for storing a sheet in a storage bag having an opening for inserting the sheet, comprising:

a supporter configured to support a portion of the storage bag in the vicinity of the opening of the storage bag;

an entering unit configured to move between a predefined standby position which is a position above the storage bag supported by the supporter and a predefined lower end position where the entering unit is in the storage bag supported by the supporter;

a driving unit configured to move the entering unit from the standby position to the lower end position;

a first detector configured to detect whether or not the entering unit is located at the lower end position;

a storage bag position adjuster configured to move the position of a bottom portion of the storage bag supported by the supporter in a substantially vertical direction; and a controller configured to control the storage bag position adjuster to lower the bottom portion of the storage bag, when it is not detected by the first detecting unit that the entering unit is located at the lower end position, such that an upper end position of the sheet stored in the storage bag supported by the supporter is maintained at a predetermined height.

10. A sheet storage method for storing a sheet in a storage bag having an opening for inserting the sheet comprising:

supporting a portion of the storage bag in the vicinity of the opening of the storage bag by a supporter;

storing the sheet in the storage bag supported by the supporter;

moving an entering unit for pressing the sheet from a predefined standby position which is a position above the storage bag supported by the supporter to a predefined lower end position where the entering unit is in the storage bag supported by the supporter;

detecting whether or not the entering unit is located at the lower end position; and moving the platform downward, when it is not detected by the first detector that the entering unit is located at the lower end position, such that an upper end position of the sheet stored in the storage bag supported by the supporter is maintained at a predetermined height.

* * * * *